US006116981A

United States Patent [19]

Zheng

[11] Patent Number: 6,116,981

[45] Date of Patent: Sep. 12, 2000

[54] CONSTRUCTIONAL PIECES WITH DEFORMABLE JOINTS

[75] Inventor: Yu Zheng, Covina, Calif.

[73] Assignee: Patent Category Corp., Walnut, Calif.

[21] Appl. No.: 08/954,323

[22] Filed: Oct. 17, 1997

Related U.S. Application Data

[63] Continuation-in-part of application No. 08/756,256, Nov. 25, 1996, which is a continuation-in-part of application No. 08/632,678, Apr. 16, 1996, Pat. No. 5,853,313.

[51] Int. Cl.[7] ..... A63H 33/08

[52] U.S. Cl. ..... 446/106; 446/106; 446/107; 446/115; 446/116; 446/121

[58] Field of Search ..... 446/85, 106, 107, 446/108, 109, 113, 114, 115, 116, 120, 121, 127; 403/345

[56] References Cited

U.S. PATENT DOCUMENTS

| | | | |
|---|---|---|---|
| D. 236,221 | 8/1975 | McAllister et al. . | |
| D. 252,951 | 9/1979 | Schuring . | |
| D. 394,091 | 5/1998 | Parry . | |
| 1,562,006 | 11/1925 | Sichterman . | |
| 1,882,607 | 3/1932 | Howard . | |
| 2,104,742 | 1/1938 | Fleischer | 446/106 |
| 2,278,327 | 3/1942 | Magnus et al. | 446/124 |
| 2,712,200 | 7/1955 | Dearling | 446/106 |
| 2,783,046 | 2/1957 | Lien . | |
| 2,844,910 | 7/1958 | Korchak | 446/85 |
| 3,199,246 | 8/1965 | Fischer | 446/108 |
| 3,432,960 | 3/1969 | Bombaci . | |
| 3,663,717 | 5/1972 | Coster . | |
| 3,699,709 | 10/1972 | Schmidt . | |
| 3,701,214 | 10/1972 | Sakamoto . | |
| 3,748,778 | 7/1973 | Ellies et al. . | |
| 3,790,175 | 2/1974 | Ragnow . | |
| 3,855,752 | 12/1974 | Aylon | 52/605 |
| 3,882,630 | 5/1975 | Bianco | 446/85 |
| 4,107,894 | 8/1978 | Mullins | 52/593 |
| 4,182,072 | 1/1980 | Much . | |
| 4,267,681 | 5/1981 | Dickson . | |
| 4,519,724 | 5/1985 | Ribas | 446/115 |
| 4,543,759 | 10/1985 | Rohrer . | |
| 4,740,188 | 4/1988 | Coster | 446/106 |
| 4,776,719 | 10/1988 | Kreider | 446/122 |
| 5,212,842 | 5/1993 | Glydon | 446/85 |
| 5,215,490 | 6/1993 | Szoradi | 446/115 |
| 5,251,900 | 10/1993 | Gallant | 273/157 R |
| 5,281,181 | 1/1994 | McCollum | 446/106 |
| 5,378,185 | 1/1995 | Ban | 446/120 |
| 5,681,201 | 10/1997 | Choi . | |

FOREIGN PATENT DOCUMENTS

| | | | |
|---|---|---|---|
| 132550 | 5/1949 | Australia | 446/114 |
| 931491 | 2/1948 | France | 446/113 |
| 956627 | 2/1950 | France | 446/113 |
| 2113462 | 6/1972 | France . | |
| 207086 | 2/1909 | Germany | 446/114 |
| 2301981 | 7/1974 | Germany | 446/106 |
| 325343 | 6/1936 | Italy | 446/113 |
| WO9415688 | 7/1994 | WIPO . | |

*Primary Examiner*—Robert A. Hafer
*Assistant Examiner*—Jeffrey D. Carlson
*Attorney, Agent, or Firm*—Raymond Sun

[57] ABSTRACT

A constructional system provides a plurality of pieces that can be used to assemble an object. The object includes a connector piece having a shaft that includes opposing first and second ends, and a first deformable section including opposing first and second bars extending from the first end of the shaft. A first notch is defined by the first bar and a first shaft edge, and a second notch is defined by the second bar and a second shaft edge, with the first deformable section having a width defined by the opposing first and second bars. The object further includes a first body piece provided with an aperture having a dimension which is smaller than the width of the first deformable section. The opposing first and second bars of the first deformable section of the connector piece are deformed to insert the first deformable section through the aperture to effectuate a connection of the first deformable section with the first body piece at the location of the aperture.

28 Claims, 25 Drawing Sheets

CONSTRUCTIONAL PIECES WITH DEFORMABLE JOINTS

RELATED APPLICATIONS

This application is a continuation-in-part of U.S. Ser. No. 08/756,256, filed Nov. 25, 1996 (pending), and entitled "Constructional Pieces With Deformable Joints", which is a continuation-in-part of U.S. Ser. No. 08/632,678, filed Apr. 16, 1996 U.S. Pat. No. 5,853,313, and entitled "Constructional Toy With Deformable Joints", whose disclosures are incorporated by this reference as though set forth fully herein.

BACKGROUND OF THE INVENTION

1. Field of the Invention

The present invention relates to a constructional piece system, and in particular, to two or three dimensional objects that can be constructed or assembled from a plurality of pieces. Each piece includes either at least one aperture, or at least one deformable section, or at least one aperture together with at least one deformable section. The deformable sections can be deformed to insert the deformable section through an aperture in another piece, the deformable section returning to its original shape after insertion through the aperture, to form a connection between the two pieces.

2. Description of the Prior Art

Constructional toys and objects are popular among both children and adults. Such constructional objects can include three-dimensional self-standing structures and objects that are assembled by interconnecting a variety of pieces.

An example of a prior constructional object assembled from pieces is illustrated in U.S. Pat. No. 2,712,200 (Dearling), in which each piece or element 10 has a tongue 18 formed by creating notches 12 at a neck 14, and a cross-shaped aperture 20 having a longitudinal slot 22 and a shorter transverse slot 24. To join the two elements 10 and 10a, the tongue 18a of element 10a is first inserted through the longitudinal slot 22 until the neck 14a reaches the opening of transverse slot 24 after which the neck 14a is twisted until it is seated in transverse slot 24. Unfortunately, the cross-shaped aperture limits the angles at which the piece 10a can be connected, thereby limiting the variety of structures or objects that can be assembled from the pieces.

Another problem associated with certain prior constructional systems is that the connections are not sufficiently stable to permit an assembled structure to be retained in a permanent state and to be moved from and to different locations. An example is illustrated in U.S. Pat. No. 5,378,185 (Ban).

Thus, there remains a need for a plurality of interconnecting pieces that can provide stable connections for the assembled object, which have enough flexibility and variety so that they can be assembled into a wide variety of different three-dimensional objects, and which objects are lightweight and can be moved around easily.

SUMMARY OF THE DISCLOSURE

In order to accomplish the objects of the present invention, there is provided a constructional system having a plurality of pieces that can be used to assemble or construct an object. The object includes a connector piece having a shaft that includes opposing first and second ends, and a first deformable section including opposing first and second bars extending from the first end of the shaft. A first notch is defined by the first bar and a first shaft edge, and a second notch is defined by the second bar and a second shaft edge, with the first deformable section having a width defined by the opposing first and second bars. The object further includes a first body piece provided with an aperture having a dimension which is substantially smaller than the width of the first deformable section. The opposing first and second bars of the first deformable section of the connector piece are deformed to insert the first deformable section through the aperture to effectuate a connection of the first deformable section with the first body piece at the location of the aperture.

In one embodiment, the connector piece further includes a second deformable section having opposing first and second bars extending from the second end of the shaft, the second deformable section also having a width defined by its opposing first and second bars. The first and second notches are further defined by the first and second bars, respectively, of the second deformable section. The shaft is fitted in the aperture with the first and second shaft edges adjacent at least one edge of the aperture to effectuate the connection.

The connector can be used to connect a second body piece to the first body piece. This is accomplished by deforming the bars of the first deformable section to insert the first deformable section through the apertures of the first and second body pieces to effectuate a connection of the first deformable section with the first and second body pieces at the location of the apertures, with the first and second body pieces being disposed parallel to each other.

In another embodiment, the connector piece further includes a third deformable section having first and second bars extending in opposite directions from a central portion of the shaft. The first notch is defined by the first bars of the first and third deformable sections, the second notch is defined by the second bars of the first and third deformable sections, a third notch is defined by the first bars of the second and third deformable sections, and a fourth notch is defined by the second bars of the second and third deformable sections. At least one body piece is received inside the first and second notches, and at least one body piece is received inside the third and fourth notches. To connect this connector to the first body piece, the bars of the third deformable section may be deformed to insert the third deformable section through the aperture of the first body piece.

In yet another embodiment, the connector piece further includes a second shaft having first and second shaft edges and opposing first and second ends, and a second deformable section having opposing first and second bars extending from the first end of the second shaft. A first notch of the second deformable section is defined by the first bar and the first shaft edge of the second shaft, and a second notch of the second deformable section is defined by the second bar and the second shaft edge of the second shaft. The second deformable section has a width defined by its opposing first and second bars. The first and second deformable sections are disposed at approximately right angles to each other. This connector may be used to connect two body pieces by deforming the opposing bars of each deformable section and inserting each deformable section into an aperture in two separate body pieces, such that the two body pieces are disposed at approximately right angles to each other. When connected, at least one body piece is received inside the first and second notches of the first deformable section, and at least one body piece is received inside the first and second notches of the second deformable section.

In a further embodiment, the connector piece has four deformable sections, with each deformable section oriented approximately ninety degrees (or at right angles) from its two adjacent deformable sections and including left and right notches on opposite side edges of its shaft.

The connector pieces according to any of the above embodiments may optionally include one or more apertures.

The body pieces according to the present invention may be provided with apertures of different shapes and sizes. In one embodiment, the width of the aperture has a dimension of about half of the width of the first deformable section. In another embodiment, the aperture has four straight edges and four convex edges, each of the straight edges being alternated by a convex edge so that each straight edge is opposed by another straight edge within the aperture and each convex edge is opposed by another convex edge within the aperture. In yet another embodiment, the aperture has a circular configuration with a circumferential edge. In yet a further embodiment, the aperture has a cross-shaped configuration comprising a longitudinal slot and a transverse slot, each slot having a length which is about half the width of the tongue so that the opposing flaps of the tongue of one of the sections of the instant piece or another piece must be bent to insert the tongue through either slot. In a further embodiment, the aperture has four straight edges connected to each other to define either a diamond-shaped or square configuration. In yet another embodiment, the aperture has three straight edges connected to each other to define a triangular configuration. In yet a further preferred embodiment, the aperture has five or more straight edges connected to each other to define a polygonal configuration.

In one embodiment, the shaft adjacent each deformable section has a width which is about the same, or slightly less than, the smallest dimension of the aperture throughout the aperture so that the shaft can be rotated inside the aperture without causing the shaft to be deformed when the pieces are rotated with respect to each other at the aperture.

In yet a further embodiment, the body piece further includes a slit extending from the aperture to a longitudinal side edge to define first and second deformable body portions adjacent the slit.

The constructional toy system according to the present invention further includes at least one wheel system, and further includes a plurality of cut-outs that have the same configuration and size as the apertures of the pieces.

Thus, the constructional system according to the present invention allows the user to assemble a large variety of simple and complex two and three-dimensional objects. The constructional system of the present invention is therefore challenging and exciting, and is a good educational toy for children. The connections of the pieces and connectors are stable, and the material used is light-weight, so that the assembled objects can be kept in a permanent state if desired and moved around easily.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
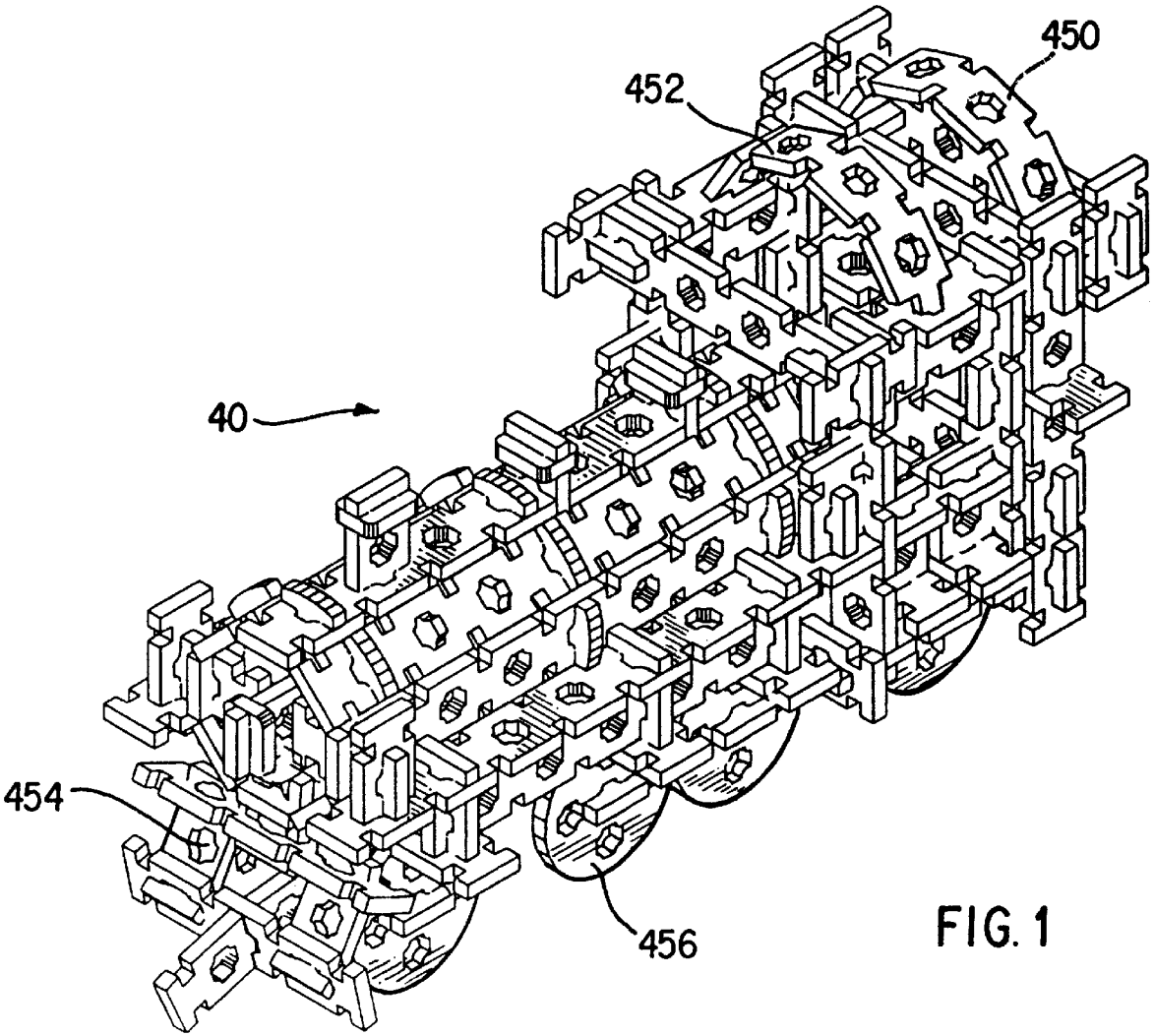
FIG. 1 is a perspective view of a three-dimensional structure, resembling a train, assembled with the pieces according to the present invention.

An example of a three-dimensional object 40 made from the constructional toy system of the present invention is shown in FIG. 1. Object 40 takes the form of the front engine of a train, and is constructed or assembled by connecting a plurality of pieces as described hereinbelow. Each piece has a deformable section which is connected to an aperture of the same or another piece to create a joint or connection. The dimensions of each aperture are sized and configured to be smaller than the width of the deformable section so that the deformable section must be deformed or bent to insert it through the aperture to create the joint. The pieces can be rotated with respect to each other at the joints. Each piece has at least one deformable section or at least one aperture, and can have any number of deformable sections and apertures. In addition, the constructional toy system according to the present invention may include wheel systems and connectors that may be used to interconnect two or more pieces. The pieces can be provided in different shapes and sizes to allow for variety in construction. For example, objects created from the pieces according to the present invention include but are not limited to planes, ships, trains, buildings, furniture, automobiles, animals, plants, belts, watches, visors, and abstract sculptures.

Examples of pieces according to the present invention are illustrated in FIGS. 2–17, 26–34 and 35–42. Each of the pieces according to the present invention is made from a material that is soft and flexible to allow it to be bent, folded or otherwise deformed, yet strong enough to allow the structures or objects created from connections of such pieces to have structural stability. Examples of such materials include but are not limited to foam, polyethylene, polyurethane and PVC (expanded foam).

1. FIGS. 1–34

Figure 2C:
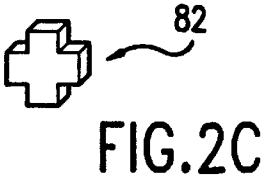
FIG. 2C is a perspective view of a cut-out from the aperture of the piece of FIG. 2A.
Figure 2B:
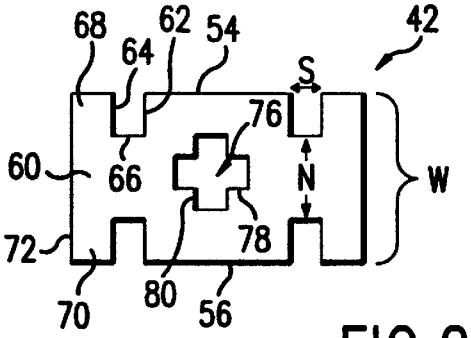
FIGS. 2A and 2B are perspective and front views, respectively, of a first embodiment of a piece according to the present invention.
Figure 2A:
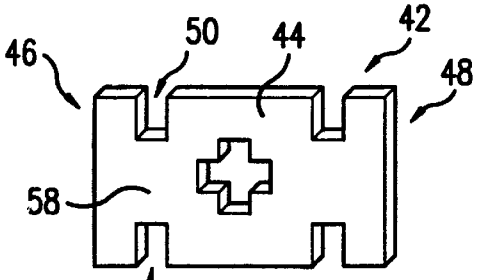

Referring to FIGS. 2A–2C, a first preferred embodiment of a piece 42 has a substantially rectangular body 44 with two deformable sections 46 and 48 at opposite ends of the body 44. The thickness of the body 44 is preferably consistent throughout. Deformable section 46 has opposing notches 50 and 52 that are cut from the longitudinal side walls 54 and 56, respectively, of the body 44 to define a neck 58 and a tongue 60. The notches 50, 52 are themselves defined by substantially straight side edges 62, 64 and a substantially straight neck edge 66. The tongue 60 has two flaps 68 and 70 (also referred to as "bars" throughout this disclosure) at opposite sides of the neck 58 and a substantially straight edge 72 at the end thereof. The deformable section 48 is identical to deformable section 46. An aperture 76 is cut out or otherwise provided in the body 44 at about a central portion thereof. The aperture 76 is substantially cross-shaped and is defined by a longitudinal slot 78 and a transverse slot 80. A cut-out 82 shown in FIG. 2C has the same configuration and size as the aperture 76 and may be used in the manner described hereinbelow.

Some non-limiting preferred dimensions for the piece 42 shall be provided to illustrate the relationship between the sizes of the tongue 60, the neck 58 and the aperture 76. The dimensions will be described relative to a basic unit "x", with x being the thickness of the body 44. For example, the width W of the deformable sections 46 and 48 is about 4x, the dimension N of the neck 58 ranges from slightly less than 2x to about 2.25x, the width S of the notches 50 and 52 is about x, and the length of both the longitudinal and transverse slots 78 and 80 is about 2x. Alternatively, the length of the longitudinal and tranverse slots 78 and 80 can be different, but the length of either slot 78 or 80 should not be much longer than 2x. In a preferred embodiment, the basic unit x is equal to 0.25 inches. It will be appreciated that the above dimensions can be changed by changing the dimension of the basic unit, and any change in one of these dimensions would necessitate a corresponding change in the other dimensions.

Figure 3C:
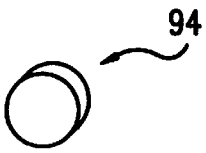
FIG. 3C is a perspective view of a cut-out from the aperture of the piece of FIG. 3A.
Figure 3B:
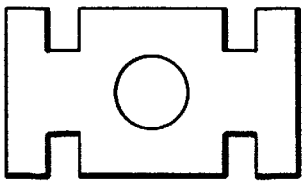
FIGS. 3A and 3B are perspective and front views, respectively, of a second embodiment of a piece according to the present invention.
Figure 3A:
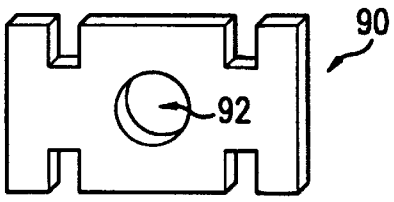

The second preferred embodiment 90 is illustrated in FIGS. 3A–3C. The piece 90 is essentially the same as the piece 42 except that the aperture 92, and its cut-out 94, are substantially circular. The relative dimensions of the aperture, neck and tongue (hereinafter referred to as "relative dimensions") are also substantially the same as those for piece 42, except that the diameter of the aperture 92 is about 2x.

Figure 4C:
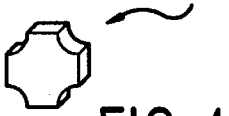
FIG. 4C is a perspective view of a cut-out from the aperture of the piece of FIG. 4A.
Figure 4B:
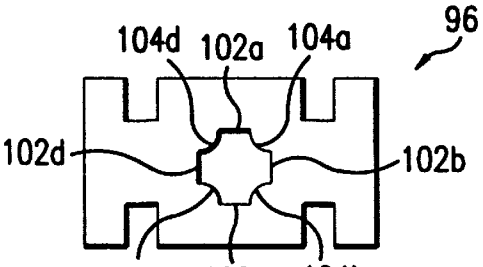
FIGS. 4A and 4B are perspective and front views, respectively, of a third embodiment of a piece according to the present invention.
Figure 4A:
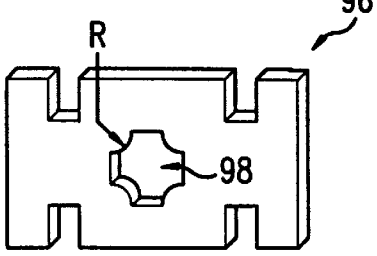

The third preferred embodiment 96 is illustrated in FIGS. 4A–4C. The piece 96 is essentially the same as the piece 42 except that the aperture 98, and its cut-out 100, are defined by four straight edges 102*a*, 102*b*, 102*c* and 102*d* and four convex edges 104*a*, 104*b*, 104*c* and 104*d*, each of the straight edges 102*a*, 102*b*, 102*c* and 102*d* being alternated by a convex edge 104*a*, 104*b*, 104*c* and 104*d* so that each straight edge is opposed by another straight edge within the aperture 98 and each convex edge is opposed by another convex edge within the aperture 98. The relative dimensions are also substantially the same as those for piece 42, except that the aperture 98 can have a dimension of at least 2x between opposing points of the edges of the aperture 98 throughout the aperture 98. For example, the distance between opposing straight edges 102*a* and 102*c*, and between opposing straight edges 102*b* and 102*d*, is about 2x, and the distance between opposing convex edges 104*a* and 104*c*, and between opposing convex edges 104*b* and 104*d*, is also about 2x. The radius R of each convex edge 104*a*, 104*b*, 104*c* and 104*d* would then be about 0.4x.

Figure 5:
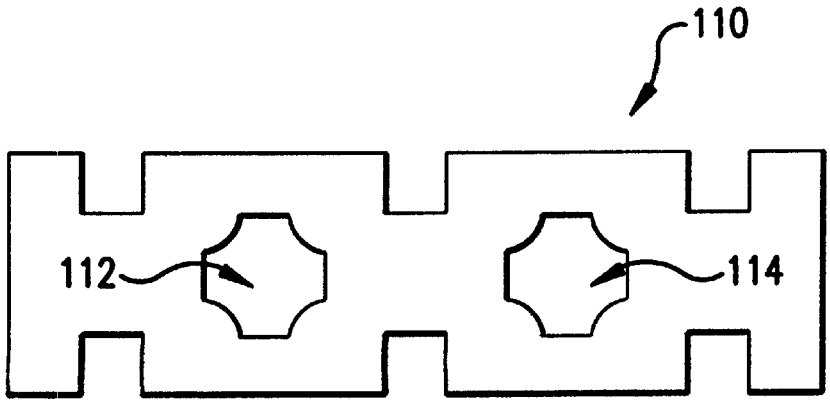
FIGS. 5–14 are front views of fourth through thirteenth embodiments of pieces according to the present invention.

The fourth preferred embodiment 110 is illustrated in FIG. 5. The piece 110 is essentially the same as the piece 42 except that it is longer and has two apertures 112 and 114. The apertures 112 and 114 have the same configuration as aperture 98 of piece 96. The relative dimensions are also substantially the same as those for piece 96, except that the length of piece 110 is longer.

Figure 6:
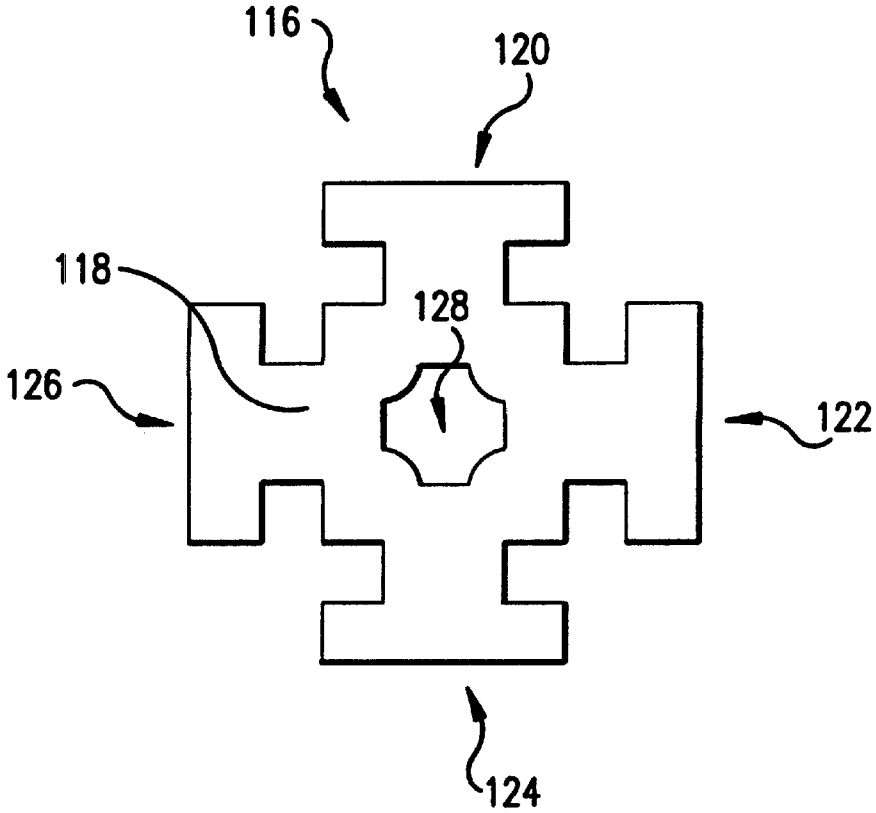

The fifth preferred embodiment 116 is illustrated in FIG. 6. The piece 116 has a substantially cross-shaped body 118 with four deformable sections 120, 122, 124 and 126, each provided at one of the four ends of the body 118. Each deformable section 120, 122, 124 and 126 is essentially the same as deformable section 46 described above. The piece 116 is also provided with one aperture 128 that has the same configuration as aperture 98 of piece 96. The relative dimensions are also substantially the same as those for piece 96.

Figure 7:
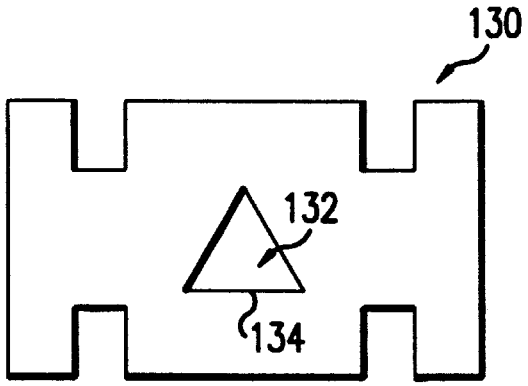

The sixth preferred embodiment 130 is illustrated in FIG. 7. The piece 130 is essentially the same as the piece 42 except that the aperture 132 is substantially triangular. The relative dimensions are also substantially the same as those for piece 42, except that the length of the aperture 132 from the apex to the midpoint of the edge 134 is about 2x.

Figure 8:
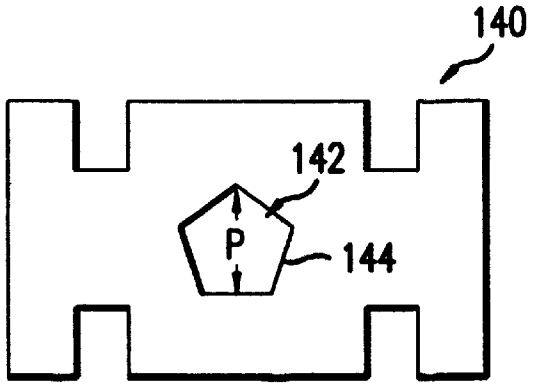

The seventh preferred embodiment 140 is illustrated in FIG. 8. The piece 140 is essentially the same as the piece 42 except that the aperture 142 is substantially polygonal having five sides. The relative dimensions are also substantially the same as those for piece 42, except that the aperture 142 can have a dimension of at least 2x between opposing points of the edges of the aperture 142 throughout the aperture 142. For example, the length p (see FIG. 8) of the aperture 142 can be at least is about 2x.

Figure 9:
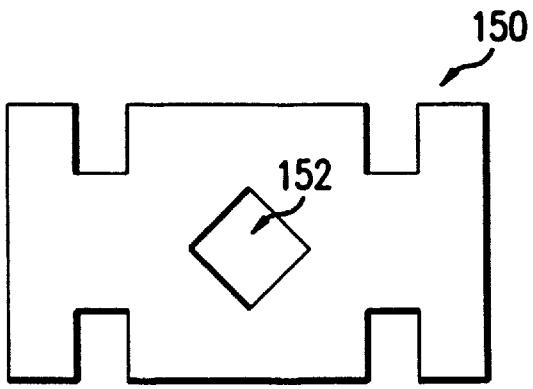

The eighth preferred embodiment 150 is illustrated in FIG. 9. The piece 150 is essentially the same as the piece 42 except that the aperture 152 is substantially diamond-shaped having four sides. The relative dimensions are also substantially the same as those for piece 42, except that the aperture 152 can have a dimension of at least 2x between opposing points of the edges of the aperture 152 throughout the aperture 152. For example, the distance between opposing side edges of the aperture 152 can be at least 2x, which means that the diagonal distance between each of the corners of the aperture 152 will be greater than 2x. In addition, it will be appreciated that the aperture 152 can also assume a substantially square configuration with four sides.

Figure 10:
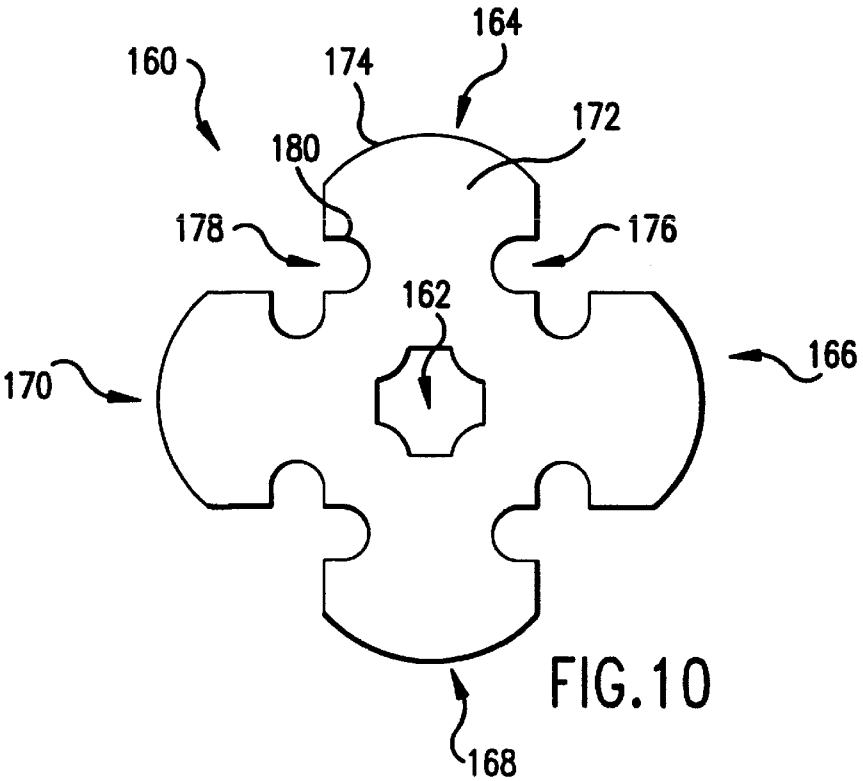

The ninth preferred embodiment 160 is illustrated in FIG. 10. The piece 160 is similar to the piece 116 in that both are substantially cross-shaped and the apertures 128 and 162 both have the same configuration. However, the four deformable sections 164, 166, 168 and 170 have a different configuration. The tongue 172 has a curved end edge 174, and the notches 176 and 178 are defined by a substantially U-shaped edge 180. Otherwise, the relative dimensions may also be substantially the same as those for piece 116.

Figure 11:
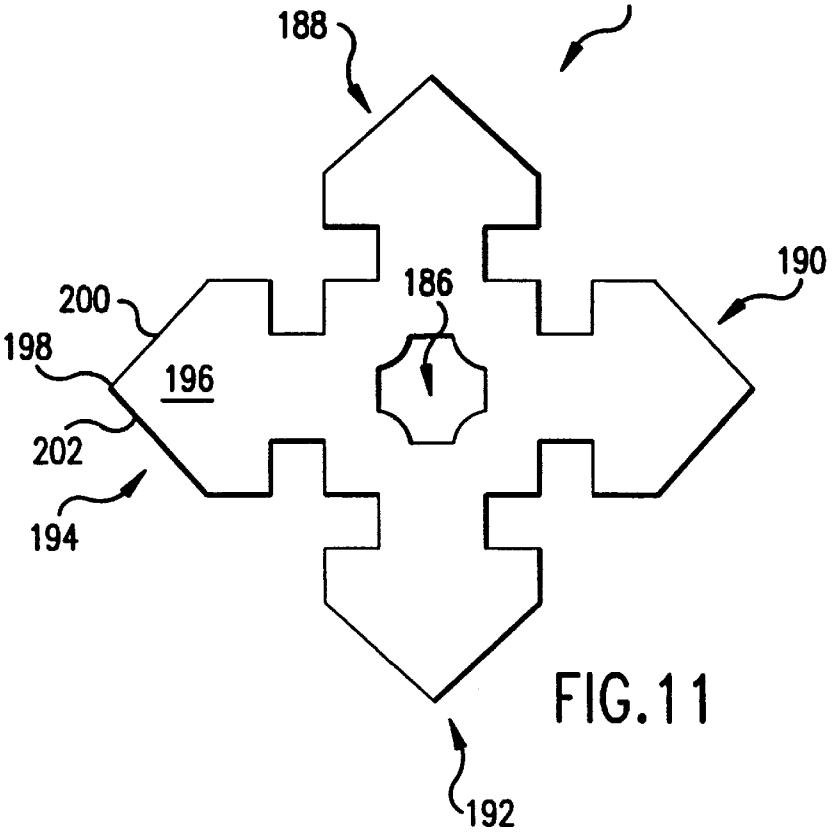

The tenth preferred embodiment 184 is illustrated in FIG. 11. The piece 184 is similar to the piece 116 in that both are substantially cross-shaped and the apertures 128 and 186 have the same configuration. However, the four deformable sections 188, 190, 192 and 194 have a different configuration. The tongue 196 is shaped similar to an arrow or triangle, having a tip 198 connecting two end edges 200 and 202. Otherwise, the relative dimensions may also be substantially the same as those for piece 116.

Figure 12:
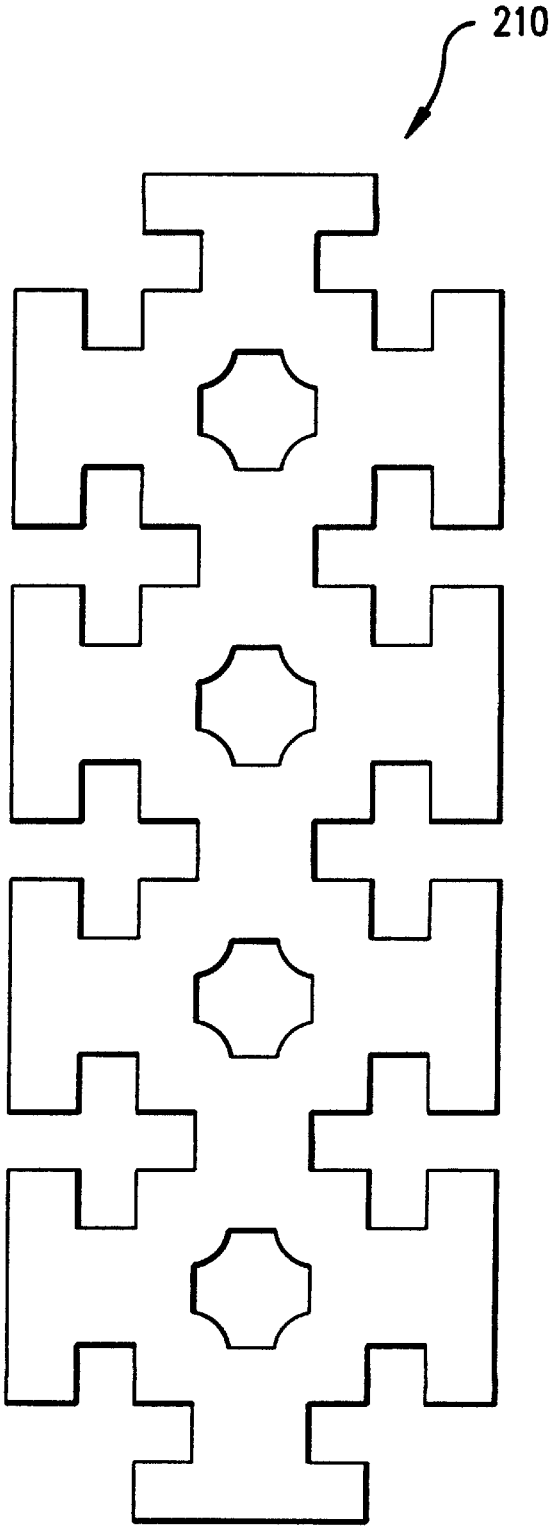

The eleventh preferred embodiment 210 is illustrated in FIG. 12. The piece 210 is essentially an extension or lengthening of the piece 116, so that piece 210 has four apertures, and a total of ten deformable sections. The piece 210 can also be viewed as a connection of a plurality of the pieces 116. The relative dimensions of the apertures, the deformable sections and the necks are also substantially the same as those for piece 116.

Figure 13:
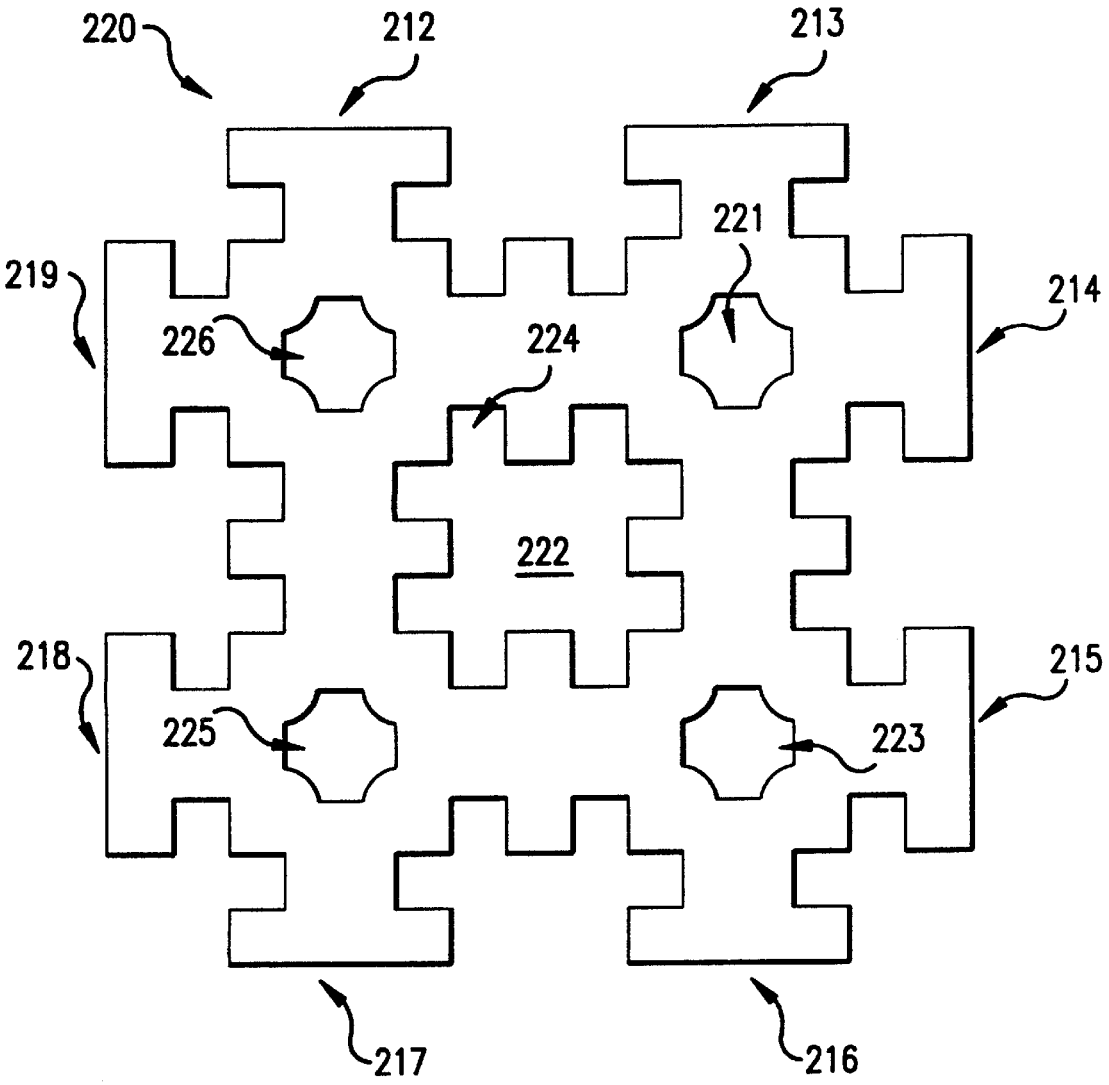

The twelfth preferred embodiment 220 is illustrated in FIG. 13. The piece 220 has eight deformable sections 212, 213, 214, 215, 216, 217, 218 and 219 and four apertures 221, 223, 225 and 226. In addition, a larger central aperture 222 is provided having notches 224 that can be connected to the connectors described hereinbelow, or just used for decorative purposes. The relative dimensions are also substantially the same as those for piece 116.

Figure 14:
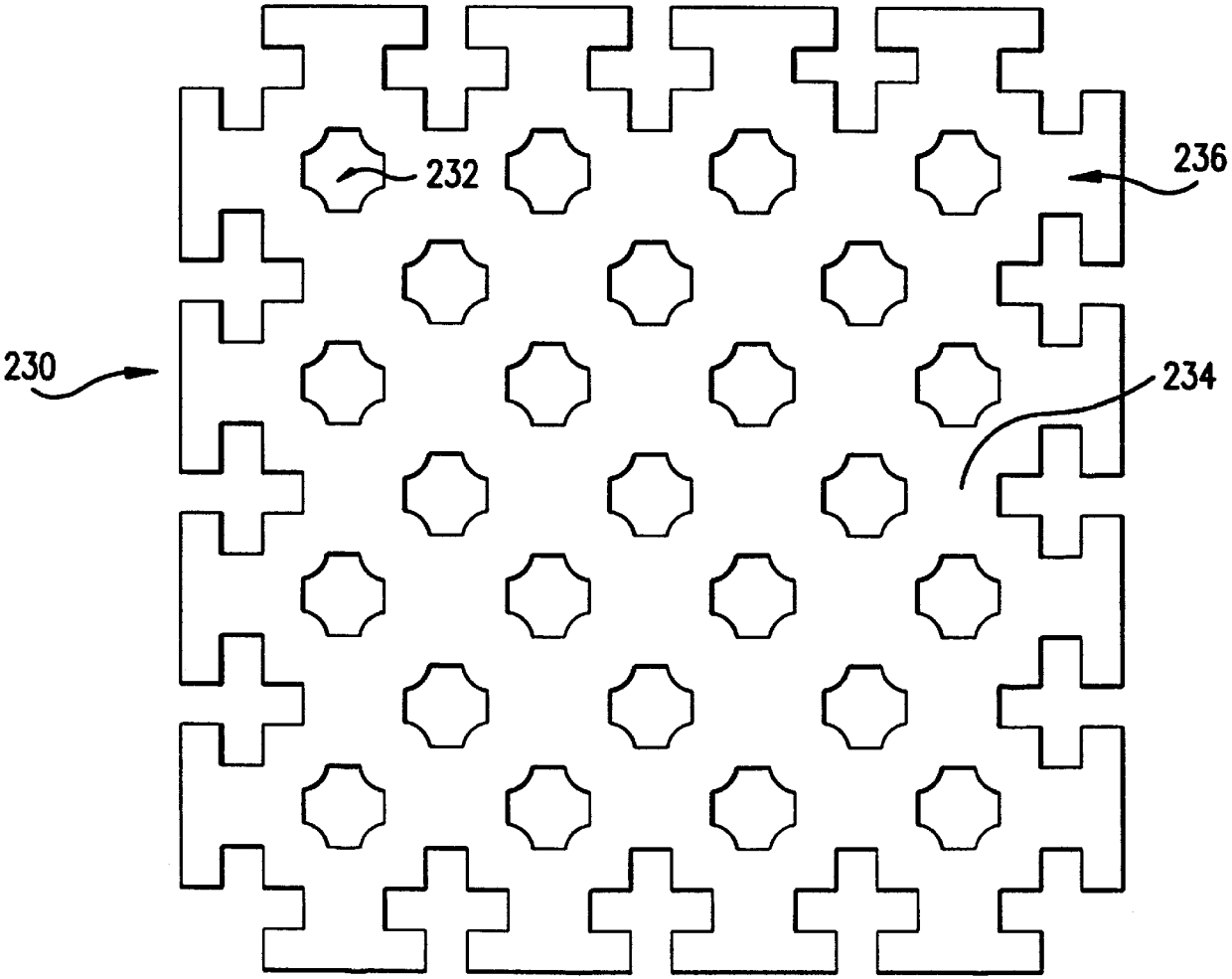

The thirteenth preferred embodiment 230 is illustrated in FIG. 14. The piece 230 has a plurality of apertures 232 spaced-apart in the body 234 and sixteen deformable sections 236 spaced-apart along the outer edges of the piece 230 with four deformable sections on each side. The relative dimensions of the apertures 232 and the deformable sections 236 are also substantially the same as those for piece 116.

Figure 15:
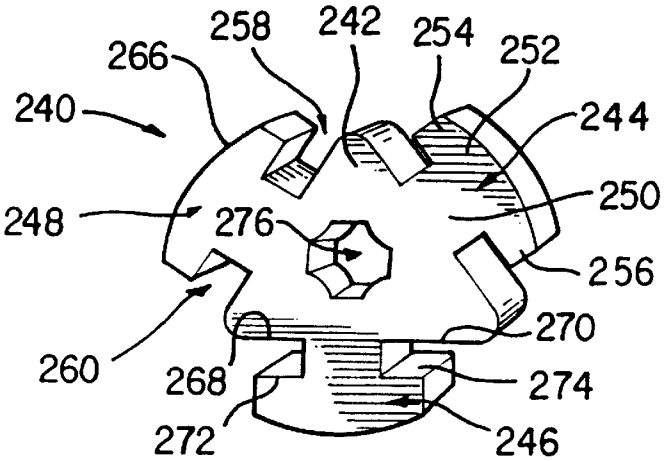
FIGS. 15–17 are perspective views of fourteenth through sixteenth embodiments of pieces according to the present invention.

The fourteenth preferred embodiment 240 is illustrated in FIG. 15. The central body 242 of the piece 240 is substantially triangular, and has three deformable sections 244, 246 and 248, each provided at one of the three sides of the body 242. The three deformable sections 244, 246 and 248 are similar to the deformable section 46 of piece 42 in that they each include a neck 250, a tongue 252 with two flaps 254, 256, and two notches 258, 260 that are the same as the corresponding elements of deformable section 46. However, the end edge 266 of each deformable section 244, 246 and 248 is curved, and side walls 268 and 270 in the notches 258, 260, respectively, are longer than side walls 272, 274. An aperture 276 is provided in the central body 242 and has the same configuration as aperture 98 of piece 96. The relative dimensions of the apertures, the deformable sections and the necks are also substantially the same as those for pieces 42 and 96.

Figure 16:
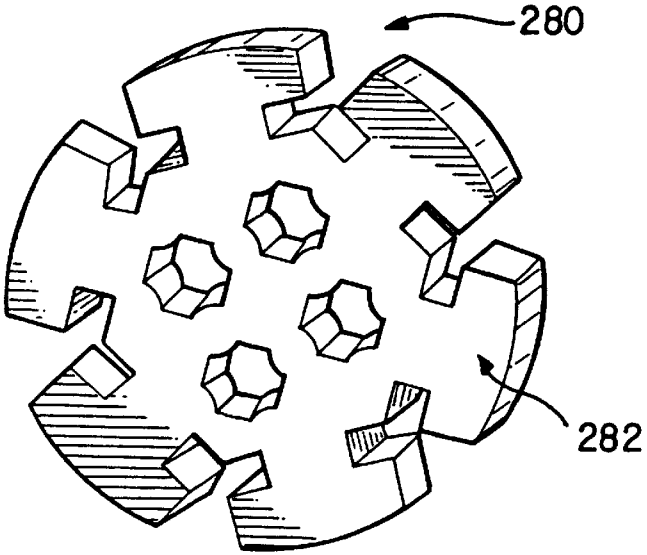

The fifteenth preferred embodiment 280 is illustrated in FIG. 16. The piece 280 is similar to the piece 240 except that it has been enlarged to assume a substantially circular configuration providing six deformable sections and four apertures. The relative dimensions of the apertures, the deformable sections and the necks are also substantially the same as those for piece 240.

Figure 17:
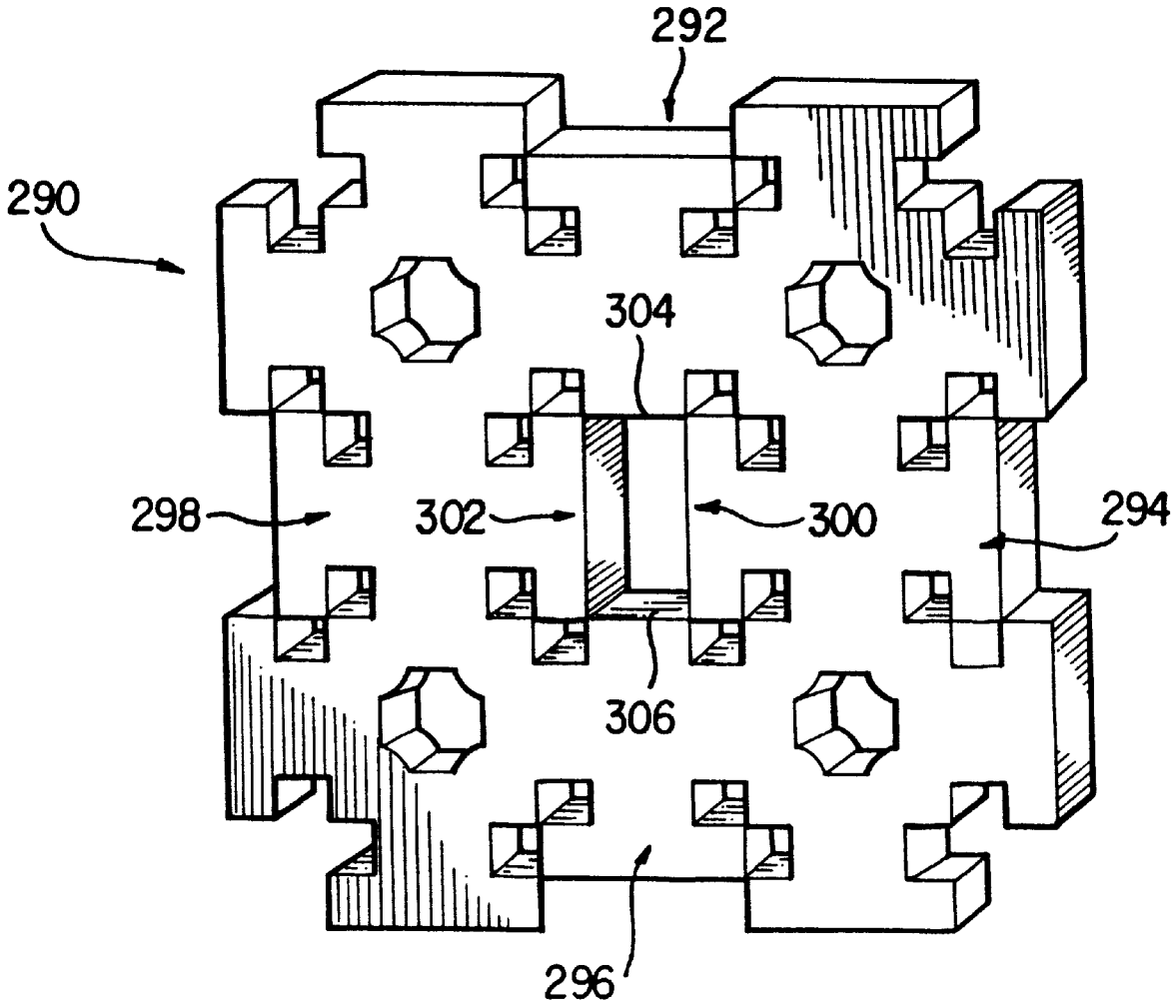
Figure 18A:
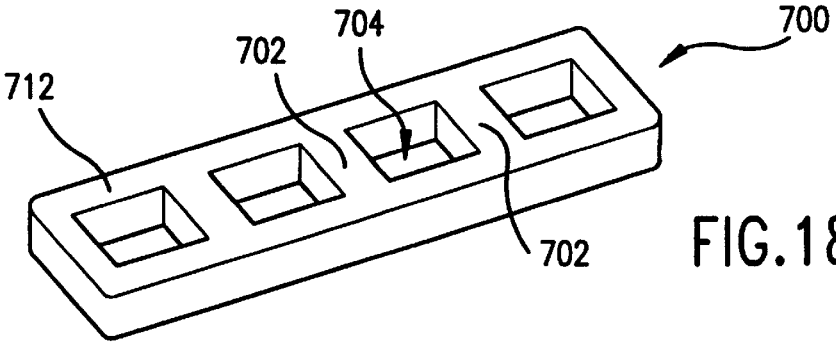
FIGS. 18A–18F are perspective views of connectors for use in connecting pieces according to the present invention.
Figure 18B:
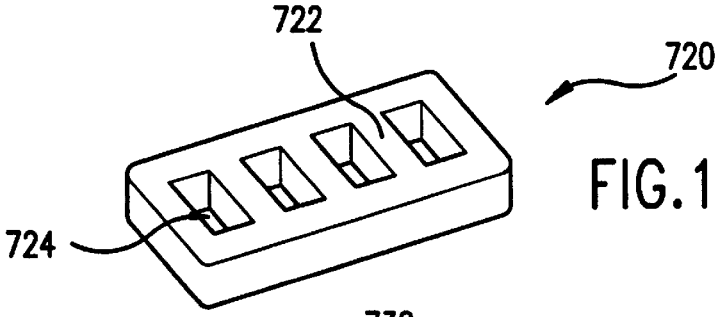
Figure 18C:
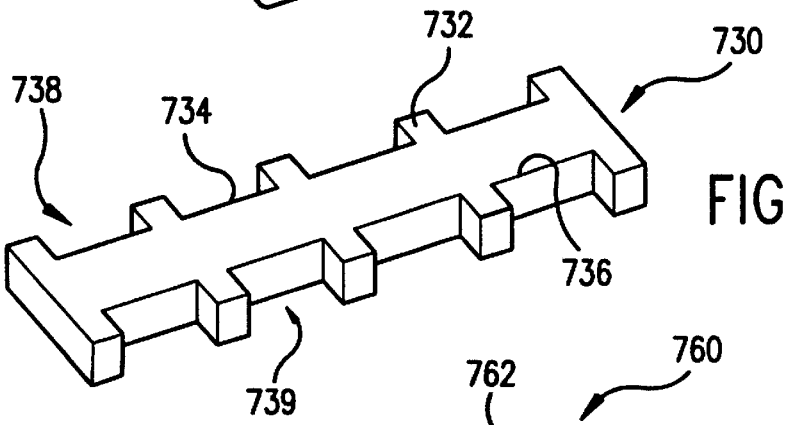
Figure 18E:
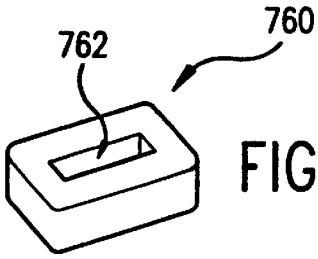
Figure 18D:
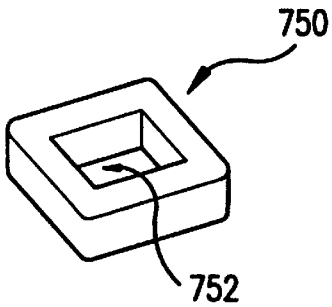
Figure 18F:
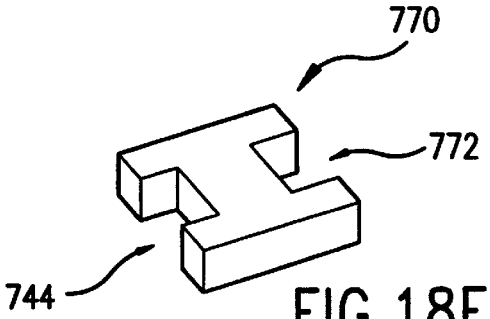

The sixteenth preferred embodiment 290 is illustrated in FIG. 17. The piece 290 is similar to piece 220 of FIG. 13, except that six additional deformable sections 292, 294, 296, 298, 300 and 302 are also provided. A substantially rectangular central aperture 304 is defined by the substantially straight end edges of the sections 300 and 302 and opposing end edges 304 and 306. The relative dimensions of the apertures, the deformable sections and the necks are also substantially the same as those for piece 220.

Figure 20C:
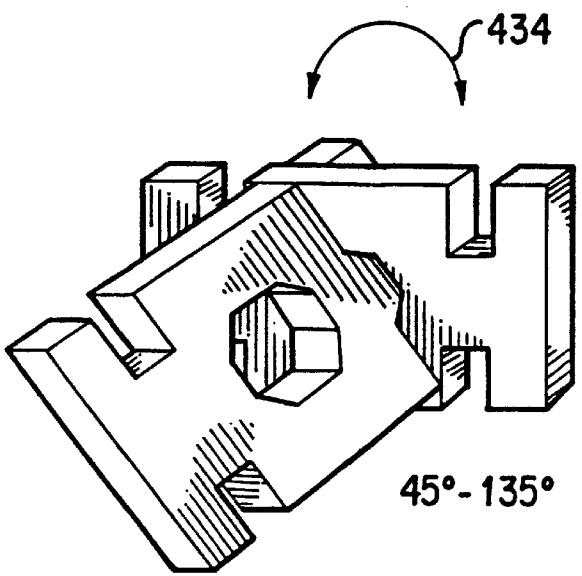
FIGS. 20A–20C illustrate how two pieces according to the present invention are connected.
Figure 20B:
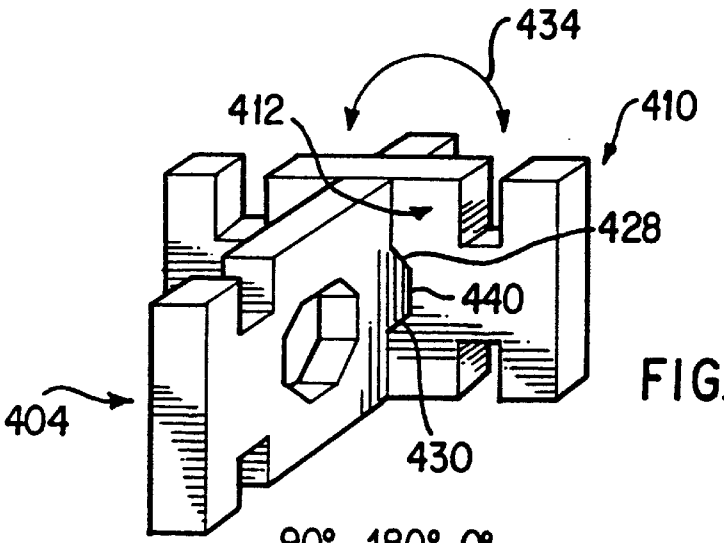
Figure 20A:
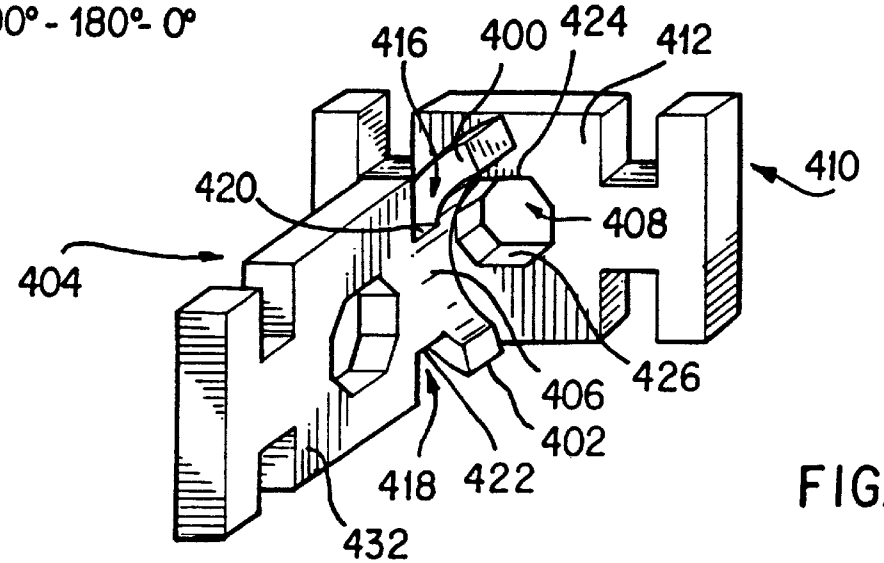

FIGS. 20A–20C illustrate how a deformable section according to the present invention is connected to the aperture of the same piece or another piece. Since the apertures according to the present invention are about half the dimension of the width W of the corresponding tongues, the tongues cannot be inserted through the apertures without deforming the tongues. Therefore, referring to FIG. 20A, the opposing flaps 400 and 402 of the deformable section of a first piece 404 are bent or folded towards each other to reduce the overall profile of the tongue 406 so that the entire tongue 406 can be inserted or passed through the aperture 408 of a second piece 410. The first and second pieces 404 and 410 have a configuration identical to that of piece 96 of FIG. 4A.

After the tongue 406 and its flaps 400, 402 have passed through the aperture 408 (see FIG. 20B), the body 412 of the second piece 410 is received inside the notches 416 and 418 of the first piece, with the neck edges 420, 422 of the notches 416, 418, respectively, positioned adjacent to or in contact with opposing straight edges 424, 426, respectively, of the aperture 408. Opposing straight edges 424, 426 correspond to edges 102*a*, 102*c* of piece 96 in FIGS. 4A and 4B. The curvature of the four convex edges that alternate with the straight edges 424, 426 (for example, two convex edges 428 and 430 shown in FIG. 20B) operate as stop means for the body 432 of the first piece 404 to prevent inadvertent rotation of the first piece 404 relative to the second piece 410.

The relative position of the first piece 404 can be manually adjusted. For example, the first piece 404 may be rotated in either direction of the arrow 434 by forty-five degrees to the position shown in FIG. 20C where the neck edges 420 and 422 are adjacent to or in contact with opposing convex edges 430, and retained in this position. Alternatively, the first piece 404 may be rotated from the position in FIG. 20B in either direction by ninety degrees to a position (not shown) where the neck edges 420 and 422 are adjacent to or in contact with opposing straight edges 440, and retained in this position.

The rotation of one piece 404 with respect to the other piece 410 can be accomplished without deforming any part of the neck portion of the tongue 406 if the dimension of the neck is slightly less than the dimension of the aperture 408 between opposing points of the edges of the aperture 408 throughout the aperture 408. This allows for a smooth and free rotation of the first piece 404 inside the aperture 408. Alternatively, it is possible to provide the width of the neck portion of the tongue 406 to be greater than the dimension of the aperture 408, so that the neck portion must be slightly deformed in order to rotate the first piece 404 inside the aperture 408.

The connection method for the other pieces of the present invention is the same. The opposing flaps of the tongues of a first piece are bent or folded to insert the tongue through the desired aperture, which may be in the first piece or in a second piece. The connected tongue may then be rotated to any desired angle relative to the aperture. The aperture can also be provided with a dimension of at least 2x between opposing points of the edges of the aperture throughout the aperture, so that the neck portions do not need to be deformed during rotation of the piece inside the aperture. Other connections can then be made with other pieces to construct the desired object. It will also be appreciated that one piece can be connected to itself. The simplest example is where one takes an elongated version of piece 110 in FIG. 5, wraps it around one's waist, and connects a deformable section to an aperture to create a belt. Watches, visors and other similar items can be created in a similar manner.

Figure 21:
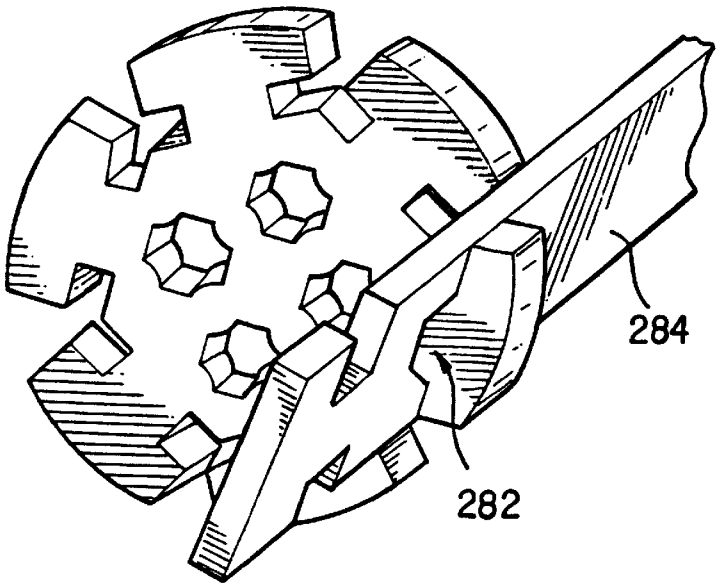
FIG. 21 illustrates the connection of a circular piece with another piece according to the present invention.

FIG. 21. illustrates the connection of the substantially circular piece 280 of FIG. 16, in which one of the deformable sections 282 is connected at an aperture of another piece 284.

To remove the connection, the opposing flaps of the deformed section are folded or bent again, and passed back through the aperture to disengage the two pieces. Although the pieces according to the present invention may be readily disengaged so that the object can be completely disassembled, the structural stability of the resulting object also allows the user to keep the object permanently without any disassembly.

Figure 23:
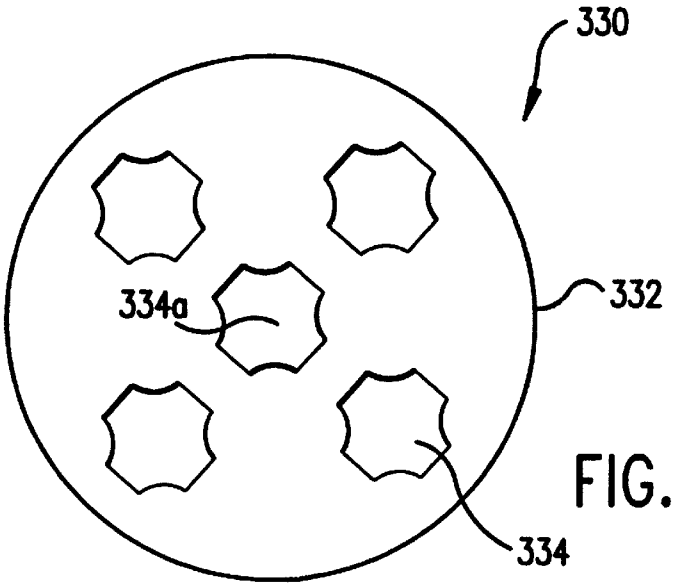
FIG. 23 is a front view of another wheel for use with objects assembled according to the present invention.
Figure 22:
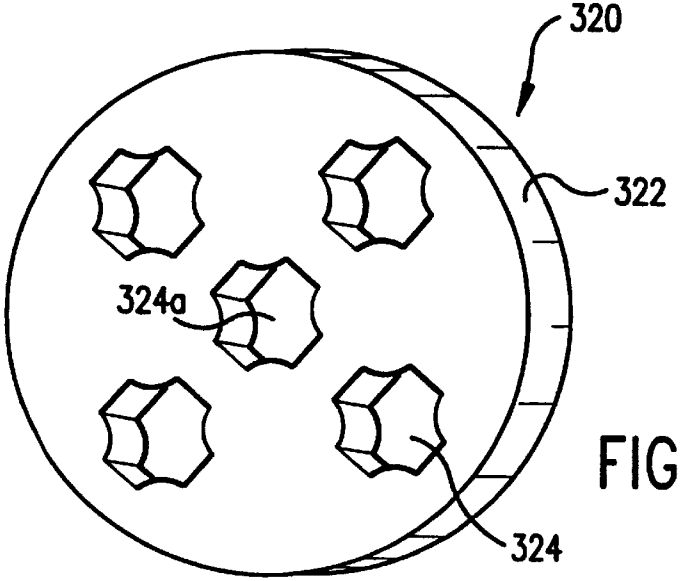
FIG. 22 is a perspective view of a wheel for use with objects assembled according to the present invention.

In addition to the pieces described elsewhere for the present invention, wheels made from the same material as the pieces can also be provided for constructing objects such as automobiles, trains, bicycles or planes. FIGS. 22 and 23 illustrate two wheels 320 and 330, each of which has a cylindrical edge 322, 332, respectively, for rotational contact with a ground or surface. The wheel 320 has five apertures 324, while the wheel 330 has seven apertures 334, each of which is configured as the aperture 98 in FIG. 4A and may be used to connect deformable sections from other pieces. Of course, the apertures 324 and 334 may have a circular or other known configuration, and the wheels 320 and 330 may be provided with a varying number of apertures and in varying sizes.

Figure 25:
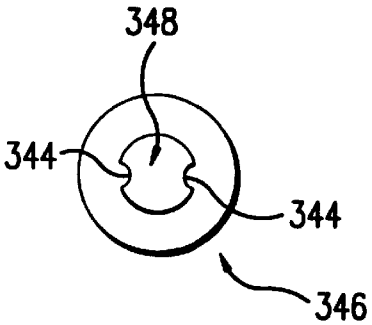
FIG. 25 is a front view of a hub or stop for use with the shaft of FIG. 24 and the wheels of FIGS. 22 and 23.
Figure 24:
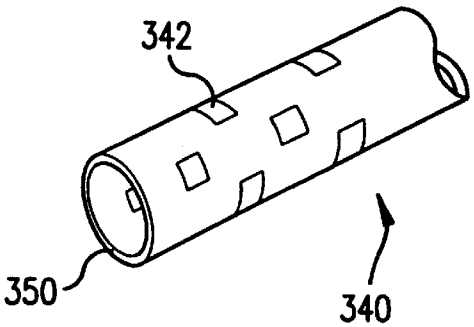
FIG. 24 is a perspective view of a portion of a shaft for use with the wheels of FIGS. 22 and 23.

The central apertures 324*a* and 334*a* of wheels 320, 330, respectively, are adapted to slidably receive a shaft, such as shaft 340 shown in FIG. 24. The shaft 340 is preferably made from a stiffer material, such as but not limited to plastic, high DPE, LDPE or VHMW, although it can also be made from the same material as the pieces. After the shaft 340 has been inserted through the central aperture 324*a* or 326*a*, the wheel 320 or 330 may be rotated about the shaft 340. The shaft 340 is provided with a plurality of openings 342 which are adapted to receive the protrusions 344 of hub or stop member 346 (see FIG. 25). The stop member 346 is also preferably made from the same material as the other pieces, and has a central opening 348 into which the two protrusions extend radially.

In use, after a wheel 320 or 330 has been slid onto the shaft 340, the front end 350 of the shaft 340 is inserted through the central opening 348 of the stop member 346 until the protrusions 344 are received in openings 342 on the shaft 340 to secure the stop member 346 at the desired location along the shaft 340. When used in this manner, the stop member 346 defines the limit of slidable advancement by the wheel 320 or 330.

Referring back to FIG. 1, it can be seen that the pieces according to the present invention can be utilized to construct complex objects having a variety of shapes and sizes. For example, the pieces 450 and 452 can be flexed to simulate curved surfaces, and a wheel is designated at 456. In addition, cut-outs can be provided to fill certain unused apertures, such as at 454, to provide an aesthetically pleasing object. For example, the pieces can be provided in certain pre-determined colors and the cut-outs can be provided in different colors to fill unused apertures in a manner that provides a colorful, playful, creative and eye-pleasing object.

Figure 28:
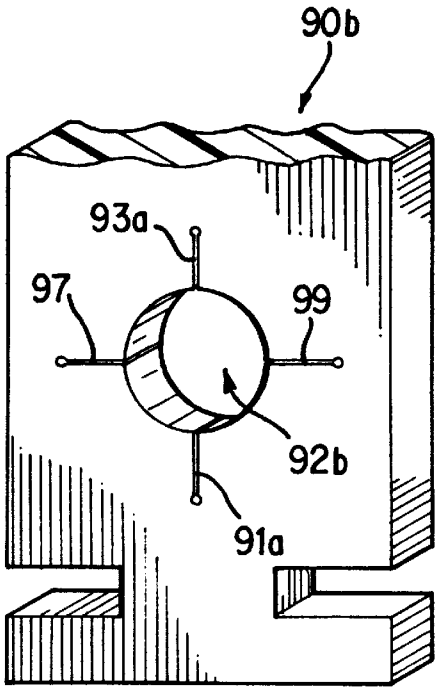
FIGS. 26–28 illustrate a seventeenth embodiment of a piece according to the present invention.
Figure 27:
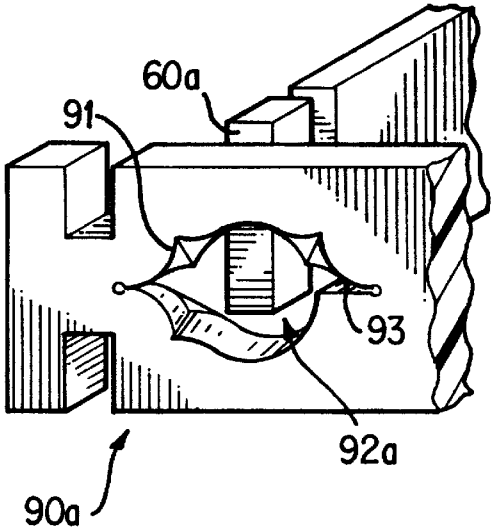
Figure 26:
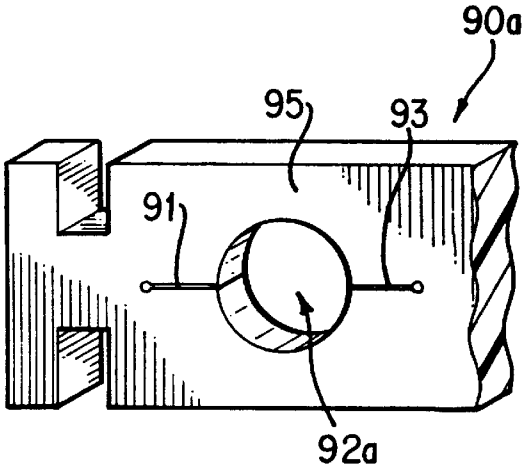

FIGS. 26 and 27 illustrate a seventeenth embodiment 90*a* of the present invention, which includes a modification to the structure of the apertures and to the method of connection. The piece 90*a* of FIG. 26 is essentially the same as piece 90 of FIG. 3A, except that pre-cut slits 91 and 93 are provided on opposing sides of the aperture 92*a*. Referring to FIG. 27, the slits 91 and 93 may be flexed to make it easier for the tongue 60*a* to be bent and passed through the aperture 92*a*. The piece 90*b* in FIG. 28 illustrates that four spaced-apart slits 91*a*, 93*a*, 97 and 99 may also be provided along the outer edge of the aperture 92*b*.

Figure 29:
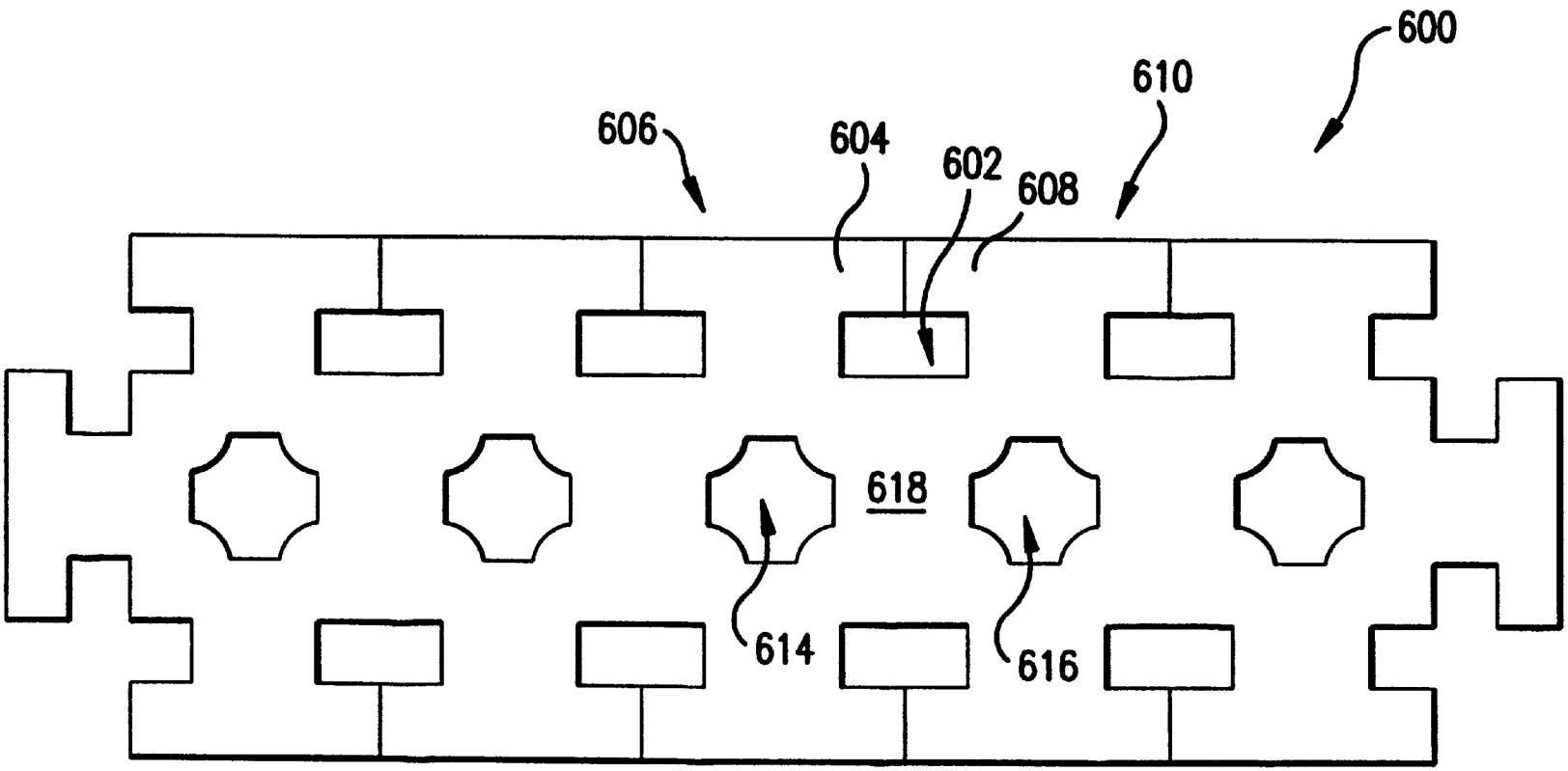
FIG. 29 is a front view of an eighteenth embodiment of a piece according to the present invention.

FIG. 29 illustrates an eighteenth embodiment 600 of the present invention which includes a modification to the piece 210 of FIG. 12. The piece 600 is provided with a plurality of substantially rectangular apertures 602 that are defined in part by the flaps of adjacent deformable sections. For example, flap 604 of deformable section 606 and flap 608 of adjacent deformable section 610 partly define an aperture 602. The piece 600 may be connected to another piece 600*a*, which is identical to piece 600, by inserting the tongues of deformable sections 606 and 610 of piece 600 through central apertures 614 and 616, respectively, of piece 600*a*, so that dividing portion 618 of the piece 600*a* is received in aperture 602 of piece 600.

Figure 30:
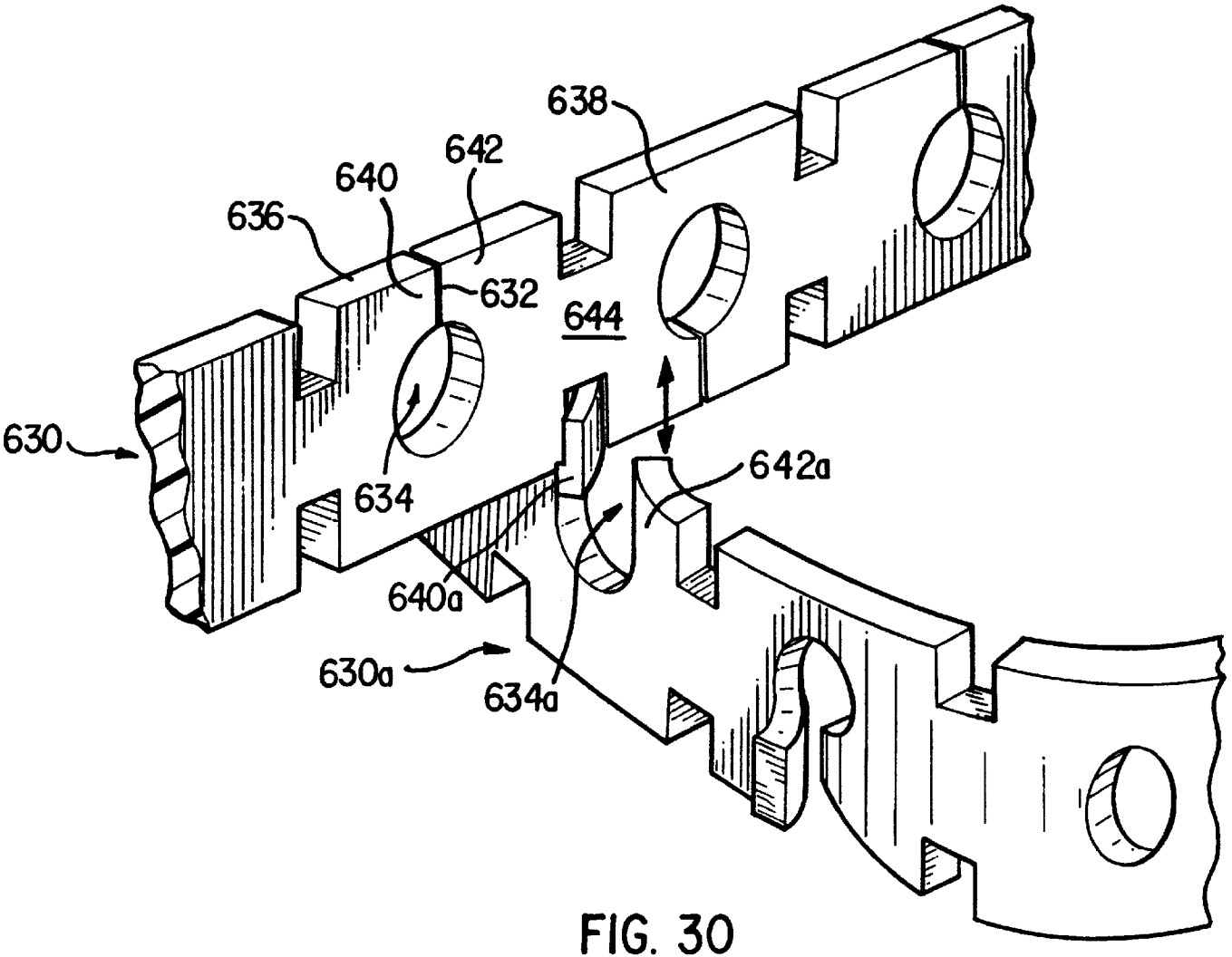
FIGS. 30 and 31 illustrate a nineteenth embodiment of a piece according to the present invention.
Figure 31:
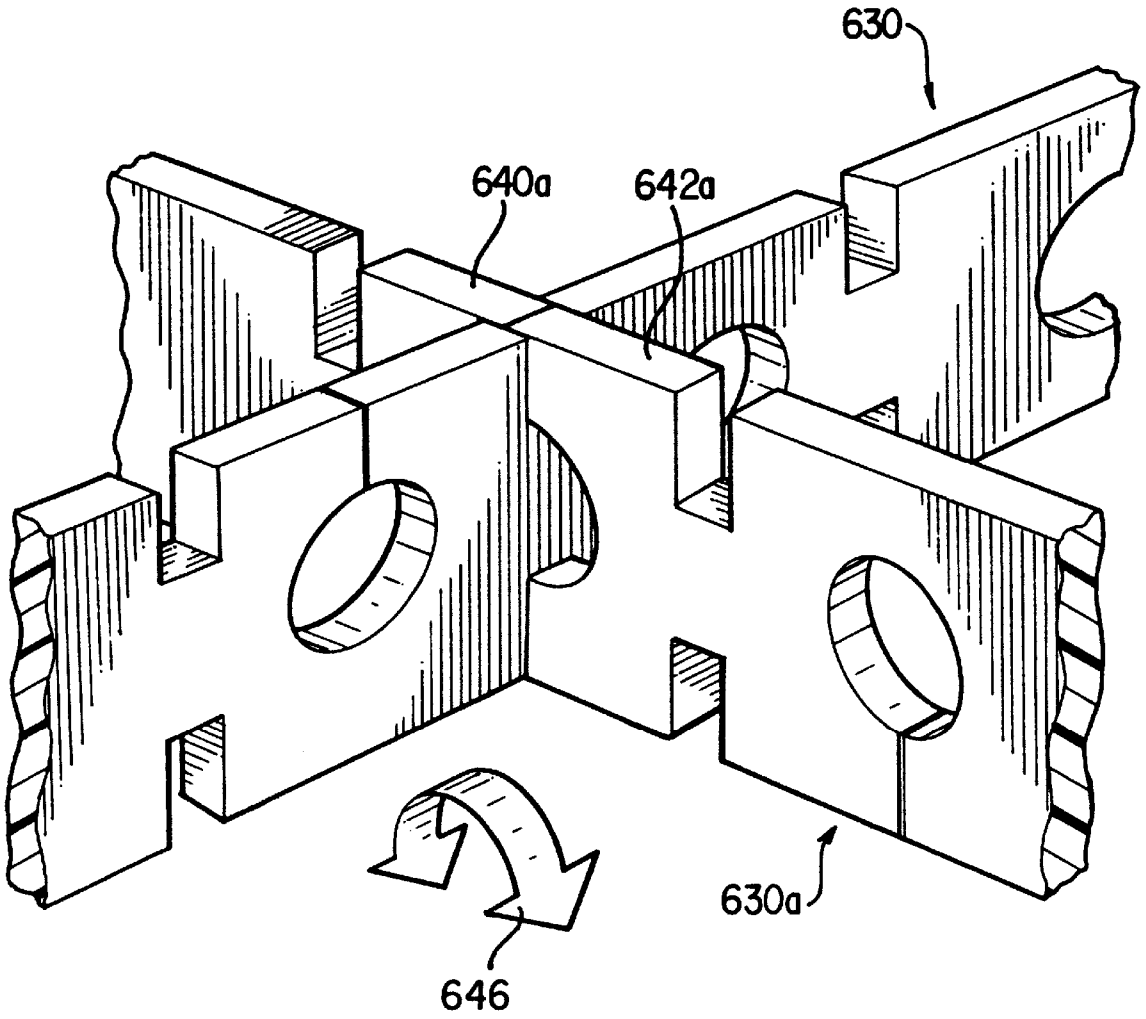

FIGS. 30 and 31 illustrate an nineteenth embodiment 630 of the present invention. The piece 630 of FIG. 30 is essentially the same as piece 90 of FIG. 3A, except that a pre-cut slit 632 has been provided to extend from the aperture 634 to the longitudinal side edge 636 of the body 638 of the piece 630. As shown in the piece 630*a* in FIG. 30, the pre-cut slit allows the body portions 640*a* and 642*a* adjacent the slit to be bent or folded aside to create an opening for inserting the neck portion 644 of the piece 630 therethrough so that the neck portion 644 can be received inside aperture 634*a*. The body portions 640*a* and 642*a* are then allowed to return to their original position, resulting in the connection shown in FIG. 31. As indicated by the arrow 646, the piece 630 may be rotated relative to the piece 630*a* to achieve the desired relative position.

Figure 32:
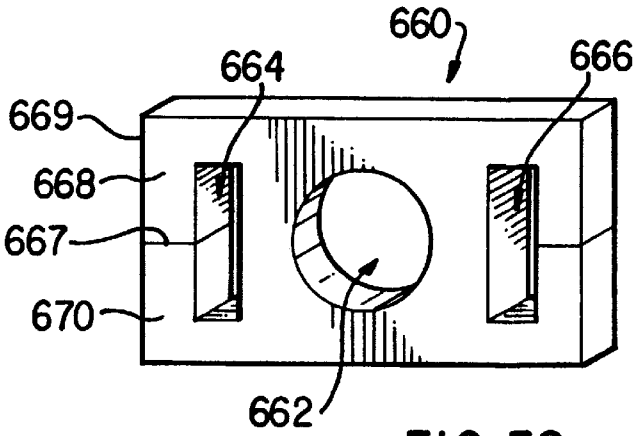
FIGS. 32 and 33 illustrate a twentieth embodiment of a piece according to the present invention.
Figure 33:
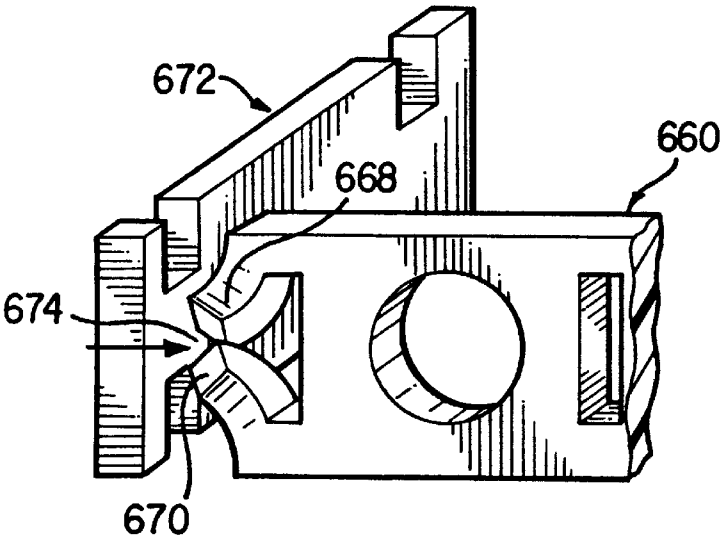

FIG. 32 illustrates a twentieth embodiment 660 of the present invention. The piece 660 has a central aperture 662 and two side apertures 664 and 666. A pre-cut slit 667 extends from about a central portion of the aperture 664 to the side edge 669 of the piece 660 to define deformable flaps or body portions 668 and 670 that may be bent or folded, as shown in FIG. 33, to create an opening at about the slit 667 for inserting the neck portion 674 of another piece 672 therethrough so that the neck portion 674 can be received inside aperture 664. The flaps 668 and 670 are then allowed to return to their original position to complete the connection. The side aperture 666 likewise has a pre-cut slit and deformable flaps and operate in the same manner as side aperture 664.

Figure 34:
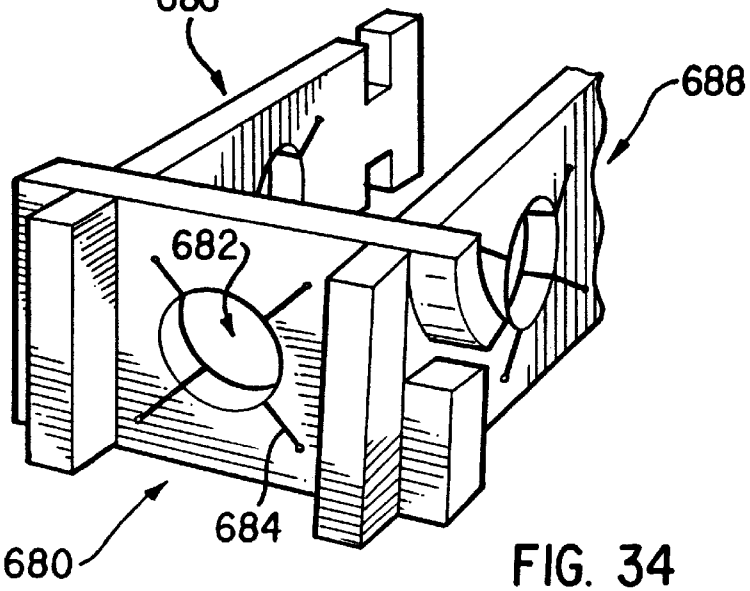
FIG. 34 is a perspective view illustrating a twenty-first embodiment of a piece according to the present invention.

FIG. 34 illustrates a twenty-first embodiment 680 of the present invention. The piece 680 is essentially the same as piece 660 of FIG. 32, except that the central aperture 682 is also provided with a plurality of pre-cut slits 684 that are similar in principle to the slits 91*a*, 93*a*, 97 and 99 described in connection with the piece 90*b* of FIG. 28. The piece 680 is shown in FIG. 34 as being connected at its side apertures to the neck portions of two other pieces 686 and 688.

In addition to the pieces and wheels described hereinabove, the constructional toy system according to the present invention may further include a set of connectors that are used to connect two or more pieces. These connectors are preferably made from the same material as the pieces. Six non-limiting examples of connectors are illustrated in FIGS. 18A–18F, and FIG. 19 illustrates these connectors in use. It will be appreciated that connectors having different configurations and sizes can be provided without departing from the spirit and scope of the present invention.

Figure 19:
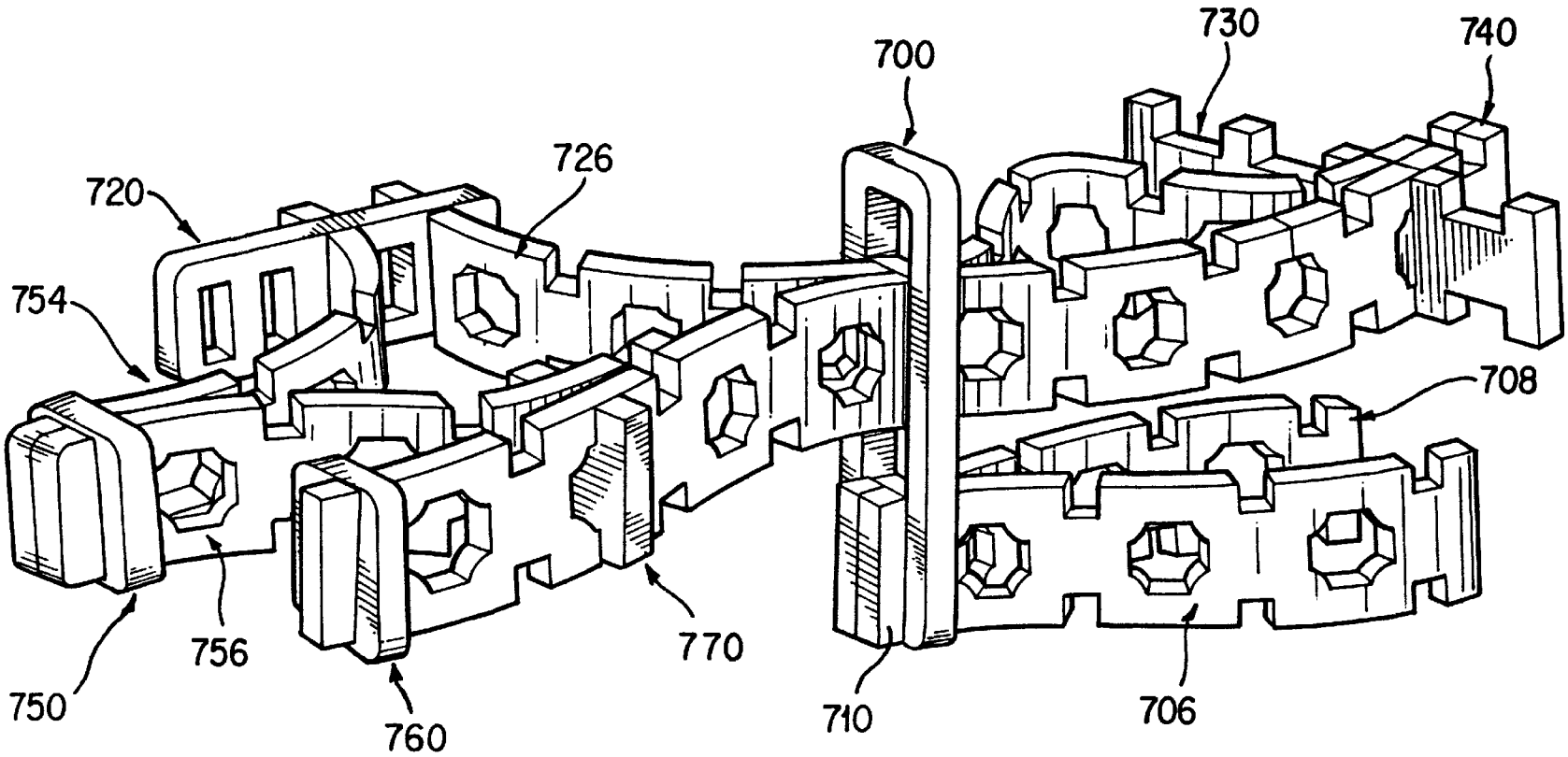
FIG. 19 illustrates the use of some of the connectors of FIGS. 18A–18F in connecting two or more pieces.

Connector 700 has a plurality of bars 702 defining a plurality of apertures 704 which are sized to receive two or more pieces, such as pieces 706 and 708 in FIG. 19. The connection is accomplished by inserting the tongue, for example tongue 710 of piece 706, through an aperture 704 so that the notches adjacent the tongue 710 receive the bars 702 that are adjacent to the connected aperture 704. Alternatively, the piece 706 can be twisted by ninety degrees so that the notches adjacent the tongue 710 receive the longitudinal side walls 712 of the connector 700.

Connector 720 also has a plurality of bars 722 defining a plurality of apertures 724. However, unlike connector 700, the apertures 724 are sized to receive one piece, such as piece 726 in FIG. 19. The connection is accomplished in the same manner described above.

Connector 730 is a longitudinal strip of material having protrusions 732 extending along its longitudinal side edges 734 and 736 that define opposing sets of notches 738, 739. The body or neck of the connector 730 may be inserted through slits formed, for example, in pieces 726 and 740 in FIG. 19 to be received inside appropriate apertures of the pieces 726 and 740. Thus, as shown in FIG. 19, one set of notches 738, 739 of the connector 730 can be used to connect or hold the ends of two pieces 726 and 740 in side-by-side manner. Alternatively, each pair of opposing notches 738, 739 may also be sized to receive the body of only one piece.

Connector 750 is shaped substantially as a ring with a single aperture 752 that is sized to receive two or more pieces, such as pieces 754 and 756 in FIG. 19. The connection is accomplished in the same manner described above for connectors 700 and 720.

Connector 760 is also shaped substantially as a ring with a single aperture 762. However, aperture 762 is sized to receive only one piece, such as piece 740 in FIG. 19, so it is not a true connector but may used as an end member or other building block for the constructional toy system of the present invention. The connection is accomplished in the same manner described above for connectors 700 and 720.

Connector 770 is similar to connector 730 but it only has one set of opposing notches 772, 774 which, as shown in FIG. 19, is used to connect two pieces 756 and 740 side-by-side in the manner described above for connector 730.

The dimensions of the above-described connectors and alternative connectors are preferably sized so that the pieces within the constructional toy system are compatible for use with these connectors. For example, the width of the aperture 724 in connector 720 is preferably about x since aperture 724 is adapted to receive one tongue. Similarly, the width of the aperture 704 in connector 700 is preferably about 2x if it is adapted to receive two tongues.

The pieces, wheels and connectors according to the present invention may be made by first providing sheets of foam, for example, and then having these sheets cut, for example, by machine-cut or another cutting operation, to provide the pieces in the desired shapes and sizes. The cut-outs, such as cut-outs 82, 94 and 100, that are produced from the cutting operation can be retained for use in the manner described above. In addition, the cut-out notches may be retained, if desired, and used to patch or fill in the unused notches in the assembled object.

2. FIGS. 35–42

FIGS. 35–42 illustrate additional embodiments of pieces and connectors according to the present invention. Each piece has at least one aperture which is adapted to receive a deformable section of a connector. Each connector can optionally include at least one aperture so that it can be connected to other connectors. Similarly, each piece can optionally include at least one deformable section so that it can be connected to other pieces.

Figure 35:
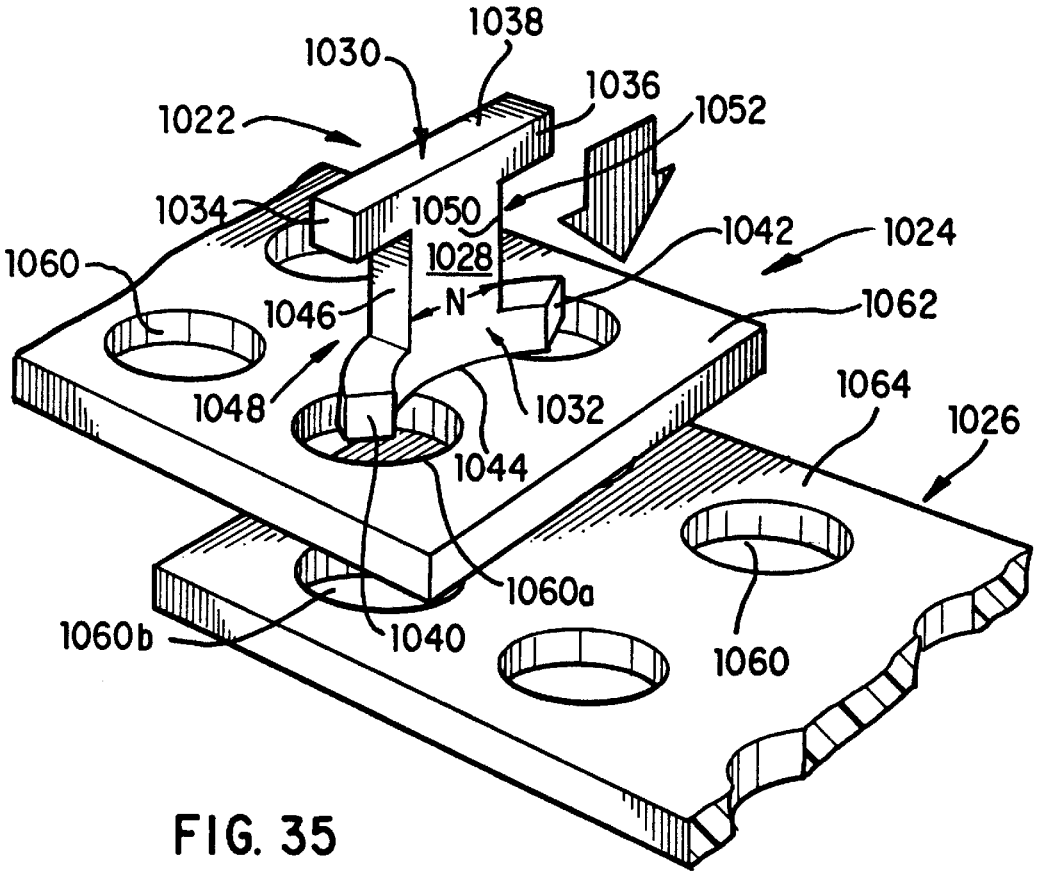
FIG. 35 illustrates a connector used to interconnect two separate pieces according to a twenty-second embodiment of the present invention.

FIG. 35 illustrates a connector 1022 according to a twenty-second embodiment used to connect two separate pieces 1024 and 1026. The connector 1022 is similar to connector 730 and has a strip of material forming a shaft 1028 (which corresponds to the neck 58 in FIG. 2A), with two deformable sections 1030 and 1032 at opposite ends thereof. The thickness of the connector 1022 is preferably consistent throughout. Deformable section 1030 has bars 1034 and 1036 (which correspond to the flaps 68, 70 in FIG. 2B) extending in opposite directions from a top edge 1038 of the shaft 1028, and deformable section 1032 has bars 1040 and 1042 extending in opposite directions from a bottom edge 1044 of the shaft 1028. Bars 1034 and 1040 together with a first side edge 1046 define a first notch 1048, and bars 1036 and 1042 together with a second side edge 1050 define a second notch 1052 opposite to the first notch 1048. The deformable sections 1030 and 1032 are preferably identical.

Portions of the pieces 1024 and 1026 are illustrated in FIG. 35. Each piece 1024 and 1026 is preferably a thin body of soft and flexible material 1062 and 1064, respectively, having a consistent thickness throughout and is provided with at least one aperture extending through the material. In this embodiment, the pieces 1024 and 1026 are provided with a plurality of substantially circular apertures 1060 that are arranged in a pattern of rows and columns. However, it will be appreciated that different arrangements of apertures on different pieces 1024 and 1026 can be used without departing from the spirit and scope of the present invention. Further, the apertures 1060 on different pieces can be provided in many different shapes, such as but not limited to those shapes illustrated above. Similarly, the pieces 1024 and 1026 can be provided in different shapes and sizes.

Some non-limiting preferred dimensions for the connector 1022 and the pieces 1024 and 1026 shall be provided to illustrate the relationship between the sizes of the deformable sections 1030 and 1032 and the apertures 1060. The dimensions will be described relative to a basic unit "x", with x being the thickness of the connector 1022 and the pieces 1024 and 1026. For example, the width of the deformable sections 1030 and 1032 is about 4x, the width N of the shaft 1028 can range from slightly less than 2x to about 2.25x, the size or opening of the notches 1048 and 1052 (i.e., the length of the side edges 1046 and 1050) is about 2x, and the diameter of the apertures 1060 is about 2x. In a preferred embodiment, the basic unit x is equal to about 0.25 inches. It will be appreciated that the above dimensions can be changed by changing the dimension of the basic unit, and any change in one of these dimensions would necessitate a corresponding change in the other dimensions.

The connector 1022 is used to connect the pieces 1024 and 1026 through apertures 1060*a* and 1060*b* according to the following method. Since the apertures 1060 according to this embodiment are about half the dimension of the width of the corresponding deformable sections 1030 and 1032, the deformable sections 1030 and 1032 cannot be inserted through the apertures 1060 without deforming the deformable sections 1030 and 1032. Therefore, referring to FIG. 35, the opposing bars 1040 and 1042 of the deformable section 1032 are bent or folded towards each other to reduce the overall profile of the deformable section 1032 so that the entire deformable section 1032 can be inserted or passed through the apertures 1060*a* and 1060*b* of the pieces 1024 and 1026, respectively. The desired apertures 1060*a* and 1060*b* must first be selected. Thereafter, the apertures 1060*a* and 1060*b* can aligned prior to the passage of the deformable section 1032 therethrough. Alternatively, the user can first insert the deformable section 1032 through the first aperture 1060*a* and then insert the deformable section 1032 through the second aperture 1060*b* to complete the connection.

Alternatively, the deformable section 1030 can be deformed and inserted through apertures 1060*b* and 1060*a*, in this order, to achieve the same connection.

Figure 36:
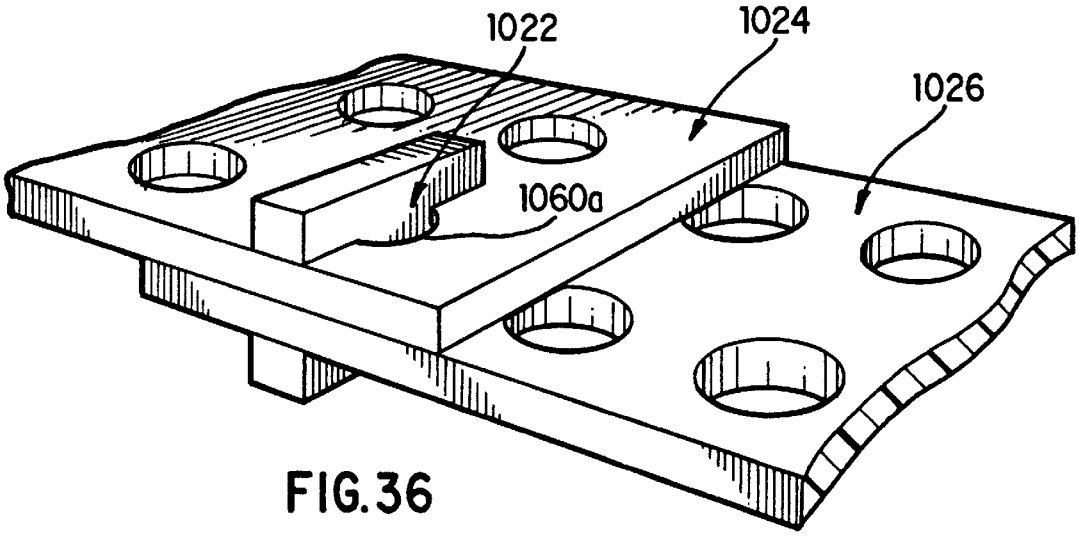
FIG. 36 illustrates the connection of two separate pieces in a parallel manner by the connector of FIG. 35.

After the deformable section 1032 and its bars 1040 and 1042 have passed through the apertures 1060*a* and 1060*b*, the pieces 1024 and 1026 will be received inside the notches 1048 and 1052. When secured in this manner, the side edges 1046 and 1050 of notches 1048 and 1052, respectively, are positioned adjacent to or in contact with the circumferential edges of the apertures 1060*a* and 1060*b*, and the bodies of the pieces 1024 and 1026 are held by the two sets of bars 1034, 1040 and 1036, 1042 that define the notches 1048 and 1052, respectively. The resulting connection is shown in FIG. 36. Pieces 1024 and 1026 are positioned parallel to each other. By "parallel", it is meant that the major plane of the body of piece 1024 is parallel to the major plane of the body of piece 1026. Since the size of the notches 1048 and 1052 has a dimension of about 2x, the bodies of the two pieces 1024 and 1026, each having a thickness of about x, will be snugly fitted inside the notches 1048 and 1052, and securely held by the connector 1022.

The relative position of pieces 1024 and 1026 can be manually adjusted. For example, piece 1024 may be rotated with respect to piece 1026 to change the orientation of the pieces 1024 and 1026. The rotation of one piece 1024 with respect to the other piece 1026 can be accomplished without deforming any part of the shaft 1028 if the dimension of the shaft 1028 is slightly less than the dimension of the apertures 1060*a* and 1060*b* between opposing points of the edges of these aperture 1060*a*, 1060*b* throughout each aperture 1060*a*, 1060*b*. This allows for a smooth and free rotation of the pieces 1024, 1026 inside the apertures 1060*a*, 1060*b*. Alternatively, it is possible to provide the width of the shaft 1028 to be greater than the dimension of the apertures 1060*a*, 1060*b*, so that the shaft 1028 must be slightly deformed in order to rotate the pieces 1024 and 1026 inside the apertures 1060*a*, 1060*b*.

To disengage the connection, the opposing bars, for example 1040 and 1042, of deformable section 1032 are folded or bent again, and passed back through the apertures 1060*a* and 1060*b* to disengage the two pieces 1024 and 1026. Although the pieces according to the present invention may be readily disengaged so that the object can be completely disassembled, the structural stability of the resulting object also allows the user to keep the object permanently assembled without any disassembly.

It will be appreciated that the size of the notches 1048 and 1052 can be adjusted to accomodate a different number of pieces in the desired connection. For example, if the connector 1022 is to be used to connect three pieces, then the notches 1048 and 1052 should have a size of about 3x, and so on.

In addition, other connectors can be connected to different apertures of piece 1024 or 1026 to connect the piece 1024 or 1026 to other body pieces. Thus, as many connectors may be applied to a piece as necessary to create the desired object Thus, by allowing the sizes and shapes of the pieces 1024 and 1026 and the connector 1022 to be varied, a constructional system can be provided which allows the user to construct an unlimited variety of objects and articles.

Figure 37:
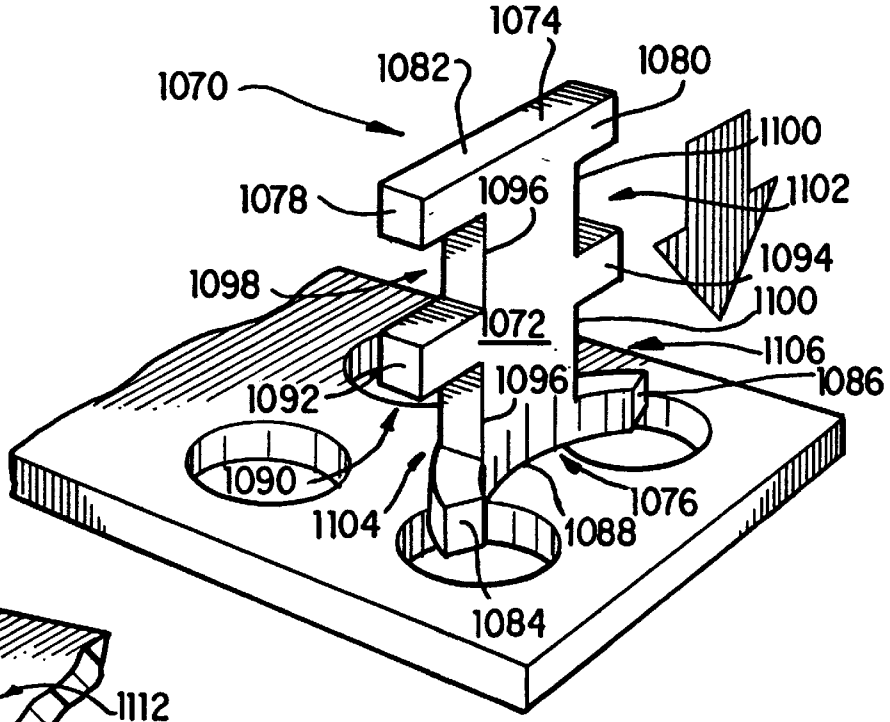
FIG. 37 illustrates a connector according to a twenty-third embodiment of the present invention.

Another connector 1070 according to a second embodiment of the present invention is illustrated in FIG. 37. The connector 1070 is similar to the connector 1022 except that it has two additional notches. The connector 1070 has a strip of material forming a shaft 1072, with first and second deformable sections 1074 and 1076 at opposite ends thereof. The thickness of the connector 1070 is preferably consistent throughout. First deformable section 1074 has bars 1078 and 1080 extending in opposite directions from a top edge 1082 of the shaft 1072, and second deformable section 1076 has bars 1084 and 1086 extending in opposite directions from a bottom edge 1088 of the shaft 1072. A third deformable section 1090 having opposing bars 1092 and 1094 extend between the first and second deformable sections 1074 and 1076. Bars 1078 and 1092 together with a first side edge 1096 define a first notch 1098, bars 1080 and 1094 together with a second side edge 1100 define a second notch 1102 opposite to the first notch 1098, bars 1084 and 1092 together with the first side edge 1096 define a third notch 1104, and bars 1086 and 1094 together with the second side edge 1100 define a fourth notch 1106 opposite to the third notch 1104. The deformable sections 1074 and 1076 are preferably identical.

Figure 38:
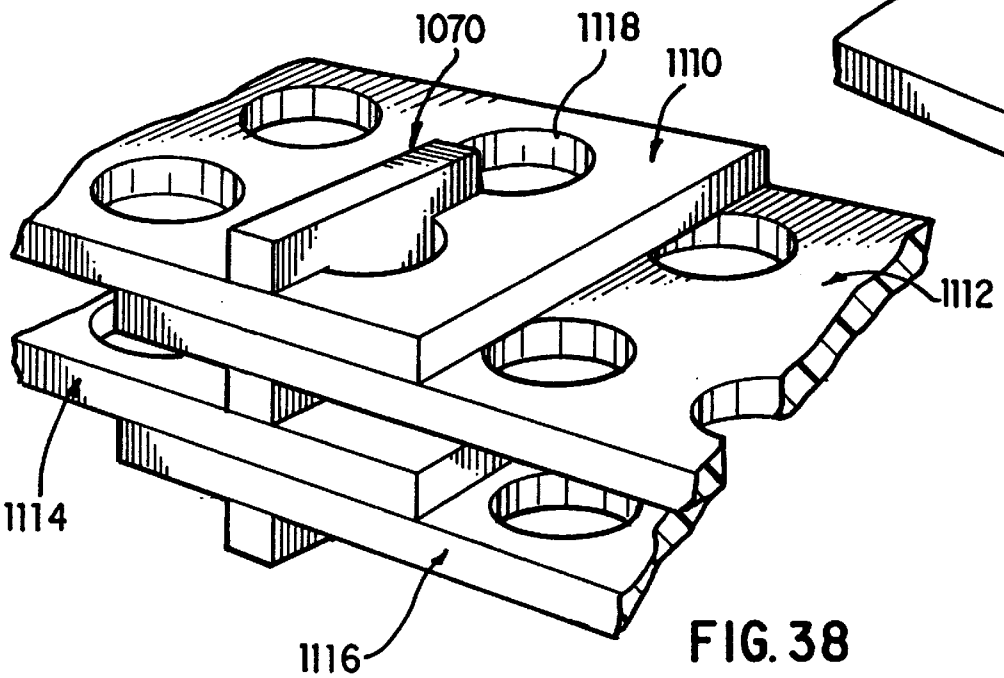
FIG. 38 illustrates the connection of four separate pieces in a parallel manner by the connector of FIG. 37.

Referring to FIG. 38, first and second notches 1098 and 1102 are adapted to receive two pieces 1110 and 1112, and third and fourth notches 1104 and 1106 are adapted to receive another two pieces 1114 and 1116. Pieces 1110, 1112, 1114 and 1116 may have the same features as pieces 1024 and 1026, and for example, are provided with substantially circular apertures 1118. The connections may be achieved according to the same method described above in connection with the embodiment of FIGS. 35 and 36. Specifically, the first deformable section 1074 is first deformed and passed through two selected apertures in pieces 1110 and 1112, and the second deformable section 1076 is then deformed and passed through two selected apertures in pieces 1114 and 1116. The four pieces 1110, 1112, 1114 and 1116 are positioned parallel to each other.

Alternatively, first deformable section 1074 or second deformable section 1076 can be deformed and passed through selected apertures in all four pieces 1110, 1112, 1114 and 1116, with third deformable section 1090 deformed and passed through selected apertures in two of the pieces 1110 and 1112, or 1114 and 1116.

Similar to notches 1048 and 1052 in connector 1022, the size of the notches 1098, 1102, 1104 and 1106 is about 2x. However, the sizes of the notches 1098, 1102, 1104 and 1106 can likewise be varied so that three or more pieces can be received within each opposing pair of notches 1098 and 1102, or 1104 and 1106.

Figure 39:
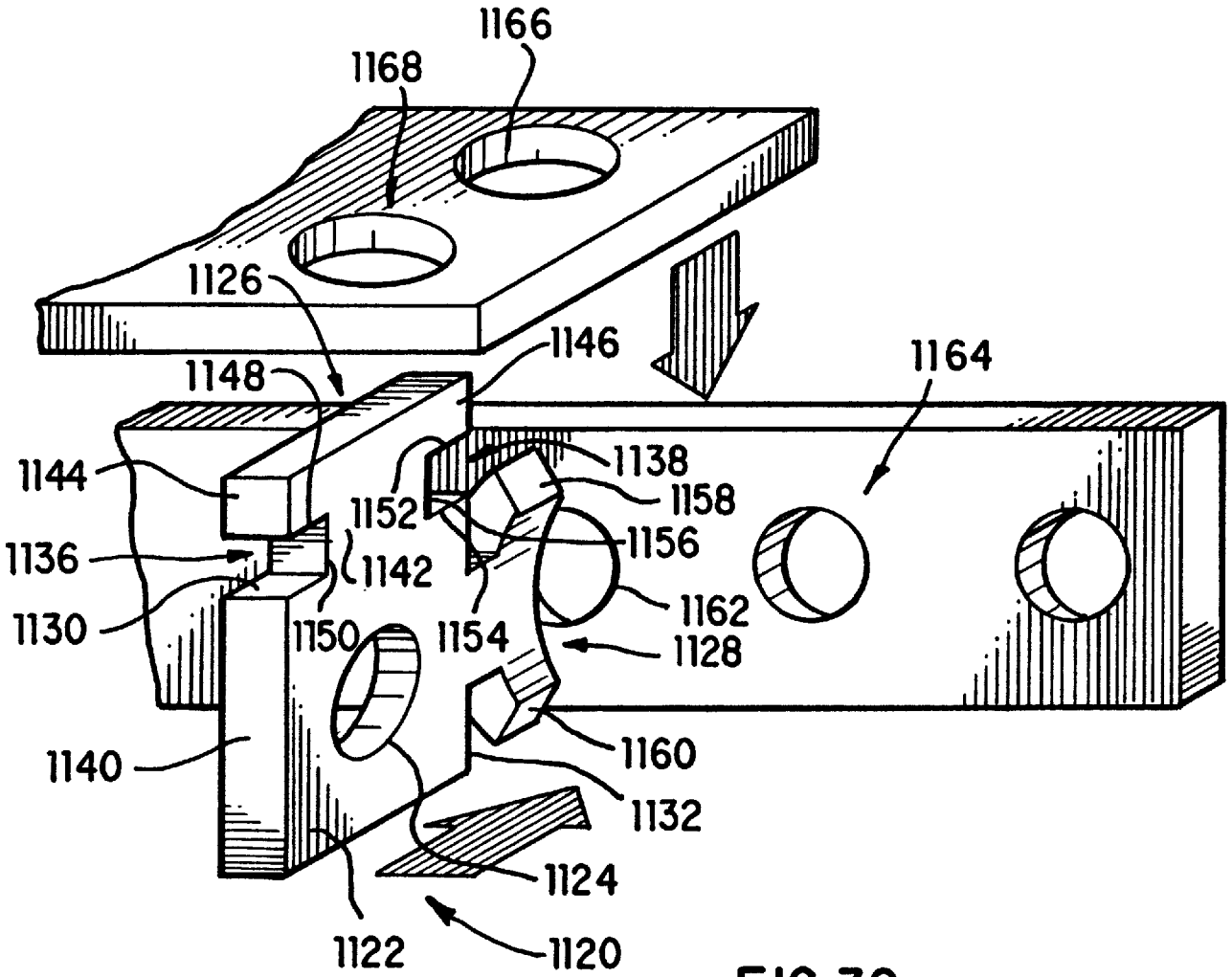
FIG. 39 illustrates a connector used to interconnect two separate pieces according to a twenty-fourth embodiment of the present invention.

Another connector 1120 according to a twenty-fourth embodiment of the present invention is illustrated in FIG. 39. Connector 1120 has a substantially square body 1122 with a substantially circular aperture 1124 provided therein. First and second deformable sections 1126 and 1128 are provided at adjacent side edges 1130 and 1132, respectively, of body 1122 which are at right angles to each other. The thickness of body 1122 is preferably consistent throughout.

Deformable section 1126 has opposing notches 1136 and 1138 that are cut from opposing longitudinal side edges 1140 and 1132, respectively, of body 1122 to define a shaft 1142 and opposing bars 1144 and 1146, respectively. Notch 1136 is itself defined by substantially straight side edges 1148 and 1130 and a substantially straight shaft edge 1150. Similarly, notch 1138 is itself defined by substantially straight side edges 1152 and 1154 and a substantially straight shaft edge 1156. The deformable section 1128 is substantially identical to deformable section 1126 except that it extends from side edge 1132. Each notch of the deformable sections 1126 and 1128 preferably has a width of about x.

Figure 40:
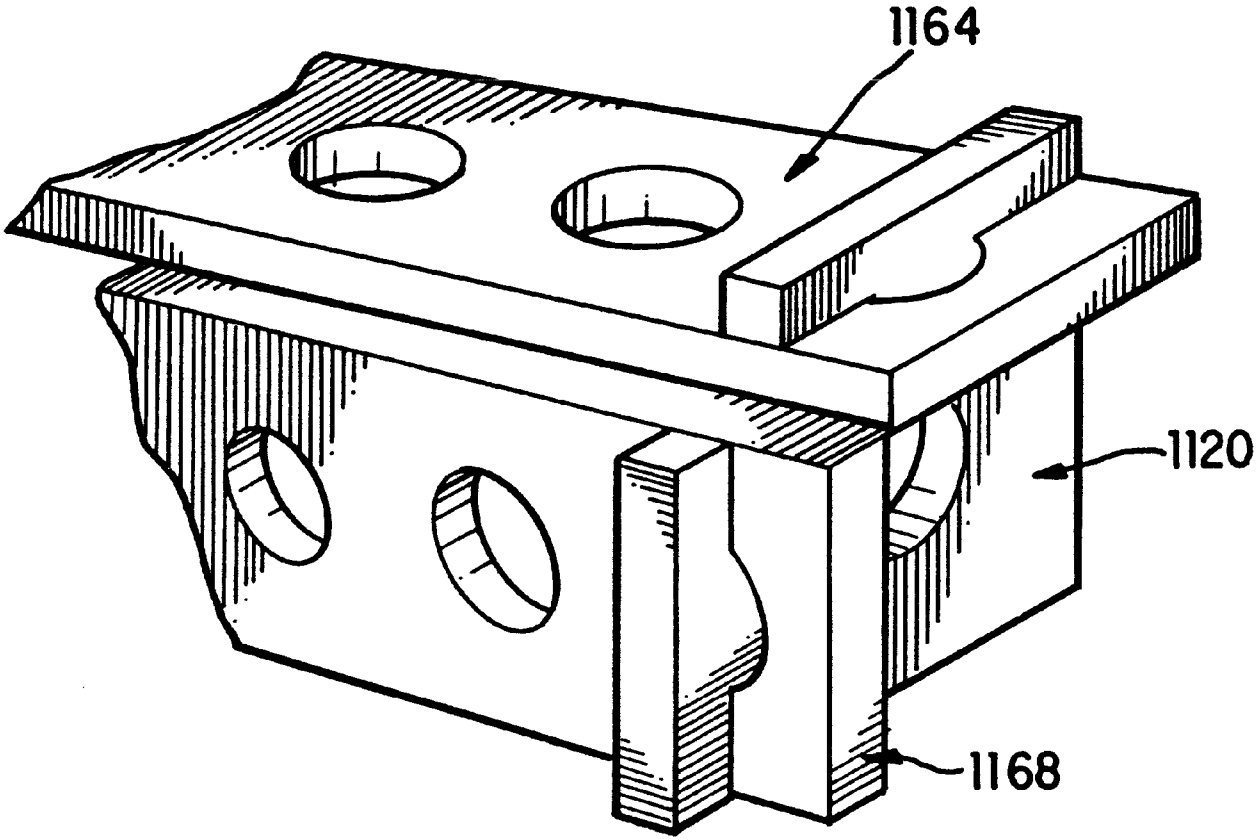
FIG. 40 illustrates the connection of two separate pieces in a perpendicular manner by the connector of FIG. 39.

The connector 1120 is used to facilitate the connection of two or more pieces at right angles (i.e., approximately ninety degrees) to each other. Referring to FIG. 39, the opposing bars 1158 and 1160 of deformable section 1128 may be deformed and passed through an aperture 1162 in a piece 1164, and the opposing bars 1144 and 1146 of deformable section 1126 may be deformed and passed through an aperture 1166 in another piece 1168. Since deformable sections 1126 and 1128 are at right angles to each other, pieces 1164 and 1168 will be connected at right angles to each other. FIG. 40 illustrates the right-angled connection of portions of the pieces 1164 and 1168 by connector 1120. The opposing notches 1136 and 1138 of the first deformable section 1126 retain the body of the piece 1168, while the opposing notches of the second deformable section 1128 retain the body of piece 1164. The connector 1120 therefore allows for the assembly of corner joints for the desired object.

The aperture 1124 in connector 1120 is adapted to receive a deformable section of another connector, thereby enabling the connector 1120 to be connected to other pieces. In this regard, the connector 1120 is not necessarily a connector and may actually also be a body piece that includes one or more deformable sections. As such, any of the body pieces according to the present invention may be provided with apertures only, or together with deformable sections to facilitate direct connection to other pieces. Conversely, a connector may be provided with one or more deformable sections, with or without any apertures.

Figure 41:
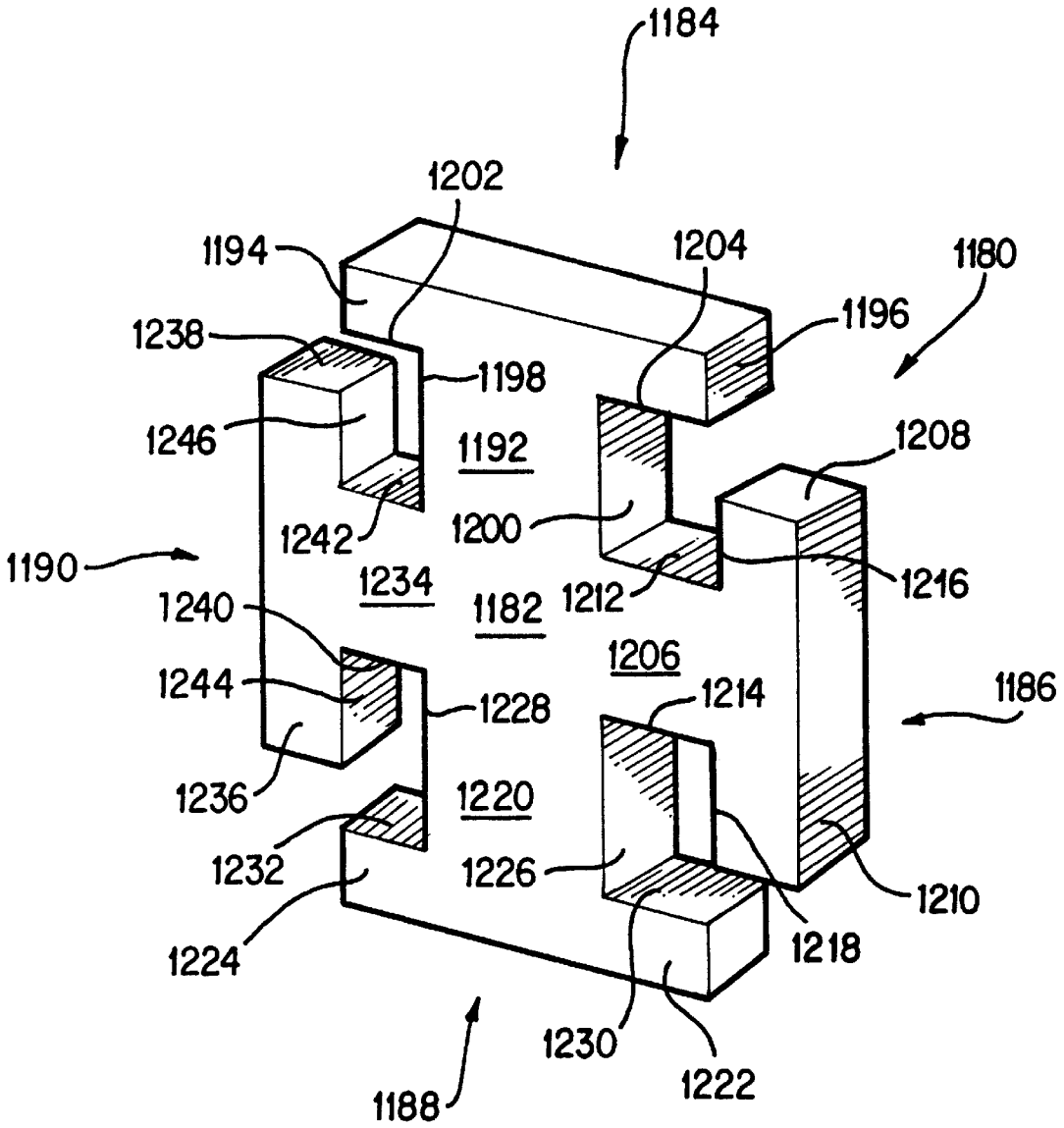
FIG. 41 illustrates an alternative connector according to a twenty-fifth embodiment that can be used to connect separate pieces in a perpendicular manner.

Another connector 1180 according to a twenty-fifth embodiment of the present invention is illustrated in FIG. 41. Connector 1180 has a substantially cross-shaped body 1182 with four deformable sections 1184, 1186, 1188 and 1190, each extending at right angles or at ninety degrees to the two adjacent deformable sections. The thickness of body 1182 is preferably consistent throughout.

First deformable section 1184 has a shaft portion 1192 with opposing bars 1194 and 1196 extending therefrom. Shaft 1192 has side edges 1198 and 1200 on either side thereof that are connected to inner edges 1202 and 1204, respectively, of bars 1194 and 1196, respectively. Similarly, second deformable section 1186 has a shaft portion 1206 with opposing bars 1208 and 1210 extending therefrom. Shaft 1206 has side edges 1212 and 1214 on either side thereof that are connected to inner edges 1216 and 1218, respectively, of bars 1208 and 1210, respectively. Third deformable section 1188 has a shaft portion 1220 with opposing bars 1222 and 1224 extending therefrom. Shaft 1220 has side edges 1226 and 1228 on either side thereof that are connected to inner edges 1230 and 1232, respectively, of bars 1222 and 1224, respectively. Fourth deformable section 1190 has a shaft portion 1234 with opposing bars 1236 and 1238 extending therefrom. Shaft 1234 has side edges 1240 and 1242 on either side thereof that are connected to inner edges 1244 and 1246, respectively, of bars 1236 and 1238, respectively.

Each of the four shafts 1192, 1206, 1220 and 1234 extends in a direction that is at about ninety degrees from the two adjacent shafts to define the cross-shaped connector 1180. Left and right notches are defined along the side edges of the shafts for each deformable section. For example, a left notch for deformable section 1184 is defined by the inner edge 1202 of bar 1194, edge 1198 of shaft 1192 and edge 1242 of adjacent shaft 1234. Similarly, a right notch for deformable section 1184 is defined by the inner edge 1204 of bar 1196, edge 1200 of shaft 1192 and edge 1212 of the other adjacent shaft 1206. As an additional example, a left notch for deformable section 1186 is defined by the inner edge 1216 of bar 1208, edge 1212 of shaft 1206 and edge 1200 of adjacent shaft 1192. Similarly, a right notch for deformable section 1186 is defined by the inner edge 1218 of bar 1210, edge 1214 of shaft 1206 and edge 1226 of the other adjacent shaft 1220. The left and right notches for deformable sections 1188 and 1190 are defined in similar manners.

Each pair of left and right notches of each of the deformable sections 1184, 1186, 1188 and 1190 is adapted to receive and secure one or more pieces. As such, the size of the notches, which can also be defined by the dimension of side edges 1198, 1200, 1212, 1214, 1226, 1228, 1240 and 1242, can have a width of about x (to receive one piece), 2x (to receive two pieces), 3x (to receive three pieces), and so on. Although the four deformable sections 1184, 1186, 1188 and 1190 are illustrated as being identical, the deformable sections can be provided in different sizes and shapes by varying the length or dimension of the shaft. As a non-limiting example, shaft 1192 can have a length of x so that its left and right notches are adapted to receive one piece, while shaft 1220 can have a length of 2x so that its left and right notches are adapted to receive two pieces. In addition, it is possible to provide the deformable sections 1184, 1186, 1188 and 1190 at an orientation in which they are oriented to each other at other than right angles.

The connector 1180 is used in the same manner as the other connectors described above. The bars of the specified deformable section are bent or folded towards each other to reduce the overall profile of the deformable section so that the entire deformable section can be inserted or passed through the desired aperture(s) in the piece(s) to be connected, with the piece(s) fitted in the left and right notches of the deformable section. In addition, one or more apertures can be provided in the body 1182 to allow other connectors to be connected to it.

Figure 42:
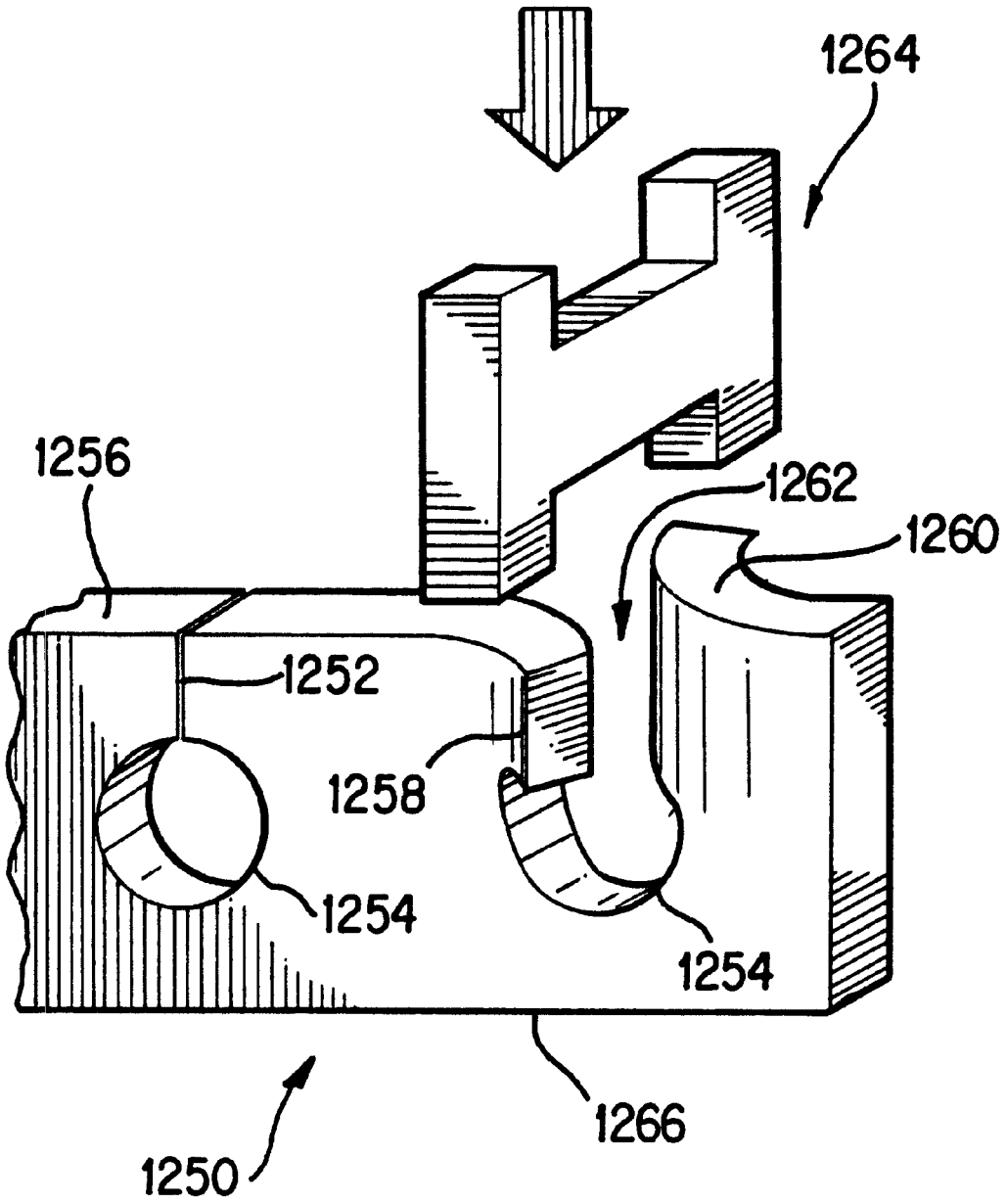
FIG. 42 illustrates a piece according to a twenty-sixth embodiment of the present invention and adapted to receive a connector.

The pieces 1110, 1112, 1114, 1116, 1164, 1168 may all have the same general features as those described above for pieces 1024 and 1026. However, FIG. 42 illustrates a twenty-sixth embodiment according to the present invention, which includes a modification to the pieces described above. The piece 1250 is essentially the same as piece 1024 of FIG. 35, except that a pre-cut slit 1252 is provided on one side of an aperture 1254 extending from the aperture 1254 to a side edge 1256 of the piece 1250. The slit 1252 divides the wall of the piece 1250 into two separate foldable or bendable flaps 1258 and 1260. Referring to FIG. 42, each flap 1258 and 1260 may be folded or bent to one side to create an opening 1262 so that a connector 1264 can be passed through the opening 1262 and fitted inside the aperture 1254. The flaps 1258 and 1260 are then allowed to return to their original position to complete the connection.

All apertures and deformable sections according to the present invention are preferably provided in corresponding configurations and sizes so that they can be used universally to interconnect other connectors and pieces. However, it is possible to provide apertures and deformable sections in a few different predetermined configurations and sizes so that certain deformable sections will be adapted for use in apertures of the corresponding size and configuration. For example, each piece may be provided with two or more sets of apertures, one set having smaller apertures adapted for connection with smaller deformable sections, a second set having larger apertures adapted for connection with larger deformable sections, and so on.

In addition, any combination of the pieces described in the present invention may be provided in the constructional system of the present invention, and any combination of configurations for the apertures and deformable sections can be provided for any piece within the system. For example, it is possible to provide different pieces with differently configured apertures, including providing a piece in which each of its apertures has a different configuration, and with each such aperture having a different size for use with deformable sections of different sizes.

The connectors and pieces according to the present invention can be decorated with designs and colors to provide aesthetically pleasing pieces. For example, the connectors and pieces can be provided in certain pre-determined colors. The surfaces of the connectors and pieces may also be laminated with printed labels or may be directly printed with graphics, decals or other decorative images.

Thus, the pieces and connectors according to the present invention can be packaged in a constructional system which allows the user to assemble a large variety of simple and/or complex two and three-dimensional objects. Adults and children will find the unlimited possibilities offered by the constructional system of the present invention to be challenging and exciting, and to be a good educational toy for children. The connections of the various pieces and connectors are stable, and the material used is light-weight, so that the assembled objects can be kept in a permanent state and moved around easily.

What is claimed is:

1. An object assembled by interconnecting a plurality of body pieces and connector pieces, the object comprising:

a connector piece comprising a body having a thickness, a shaft having a width, first and second shaft edges and opposing first and second ends, and a first deformable section comprising opposing first and second bars extending from the first end of the shaft, a first notch defined by the first bar and the first shaft edge, and a second notch defined by the second bar and the second shaft edge, the first deformable section having a width defined by the opposing first and second bars; and a first body piece comprising a body having a thickness and further comprising an aperture comprising at least one edge and having a dimension which is smaller than the width of the first deformable section, and a dimension which is greater than the width of the shaft, the aperture having a circular configuration with a circumferential edge, and wherein the opposing first and second bars of the first deformable section of the connector piece are deformed to insert the first deformable section through the aperture to effectuate a connection of the first deformable section with the first body piece at the location of the aperture.

2. An object assembled by interconnecting a plurality of body pieces and connector pieces, the object comprising:

a connector piece comprising a body having a thickness, a shaft having a width, first and second shaft edges and opposing first and second ends, and a first deformable section comprising opposing first and second bars extending from the first end of the shaft, a first notch defined by the first bar and the first shaft edge, and a second notch defined by the second bar and the second shaft edge, the first deformable section having a width defined by the opposing first and second bars; and a first body piece comprising a body having a thickness and further comprising an aperture comprising at least one edge and having a dimension which is smaller than the width of the first deformable section, and a dimension which is greater than the width of the shaft, wherein the aperture comprises four straight edges connected to each other, and wherein the first and second shaft edges are adjacent opposing straight edges of the aperture when the deformable section is connected to the first body piece at the location of the aperture; and wherein the opposing first and second bars of the first deformable section of the connector piece are deformed to insert the first deformable section through the aperture to effectuate a connection of the first deformable section with the first body piece at the location of the aperture.

3. An object assembled by interconnecting a plurality of body pieces and connector pieces, the object comprising:

a connector piece comprising a body having a thickness, a shaft having a width, first and second shaft edges and opposing first and second ends, and a first deformable section comprising opposing first and second bars extending from the first end of the shaft, a first notch defined by the first bar and the first shaft edge, and a second notch defined by the second bar and the second shaft edge, the first deformable section having a width defined by the opposing first and second bars; and a first body piece comprising a body having a thickness and further comprising an aperture comprising at least one edge and having a dimension which is smaller than the width of the first deformable section, and a dimension which is greater than the width of the shaft, wherein the opposing first and second bars of the first deformable section of the connector piece are deformed to insert the first deformable section through the aperture to effectuate a connection of the first deformable section with the first body piece at the location of the aperture; and a plurality of cut-outs that have the same configuration and size as the aperture of the first body piece.

4. A method of assembling a plurality of pieces to create an object, comprising the steps of:

a. providing a connector piece comprising a body having a thickness, a shaft having first and second shaft edges and opposing first and second ends, and a first deformable section comprising opposing first and second bars extending from the first end of the shaft, a first notch defined by the first bar and the first shaft edge, and a second notch defined by the second bar and the second shaft edge, the first deformable section having a width defined by the opposing first and second bars;

b. providing a body piece comprising a body having a thickness and further comprising an aperture having a dimension which is smaller than the width of the first deformable section, and a dimension which is greater than the width of the shaft;

c. bending the opposing bars of the first deformable section to insert the first deformable section through the aperture of the body piece to effectuate a connection of the first deformable section with the body piece at the location of the aperture with the shaft fitted in the aperture of the body piece; and d. rotating the shaft within the aperture without deforming any portion of the shaft.

5. The method of claim 4, further comprising the steps of:

d. providing a second body piece comprising a body having a thickness and further comprising an aperture having a dimension which is smaller than the width of the first deformable section, and a dimension which is greater than the width of the shaft; and e. bending the opposing bars of the first deformable section to insert the first deformable section through the aperture of the second body piece to effectuate a connection of the first deformable section with the second body piece at the location of the aperture.

6. The method of claim 4, wherein the body piece further comprises a second aperture, the method further comprising the steps of:

d. providing a second connector piece comprising a body having a thickness, a shaft having first and second shaft edges and opposing first and second ends, and a first deformable section comprising opposing first and second bars extending from the first end of the shaft, a first notch defined by the first bar and the first shaft edge, and a second notch defined by the second bar and the second shaft edge, the first deformable section having a width defined by the opposing first and second bars; and e. bending the opposing bars of the first deformable section of the second connector piece to insert the first deformable section of the second connector piece through the second aperture of the body piece.

7. The method of claim 4, wherein step (b) further includes the step of providing at least one slit extending for a short distance along the body piece from the aperture, the slit defining first and second deformable body portions adjacent the slit, and wherein step (c) further includes the step of deforming the first and second deformable body portions adjacent the slit during insertion of the first deformable section to further facilitate insertion of the first deformable section through the aperture.

8. An object assembled by interconnecting a plurality of pieces, the plurality of pieces including a first piece and a second piece, the object comprising:

a first piece having a shaft having a first end, the first piece further including a first deformable section including opposing first and second bars extending from the first end of the shaft to define first and second notches, the opposing first and second bars also defining the width of the first deformable section; and a second piece including an aperture having a width with a dimension which is the same as or greater than the width of the shaft of the first deformable section of the first piece;

wherein the width of the first deformable section is greater than the largest dimension of the aperture so that the opposing first and second bars of the first deformable section of the first piece are deformed to insert the first deformable section through the aperture of the body piece to effectuate a connection of the first deformable section with the second piece at the location of the aperture wherein the shaft of the first deformable section of the first piece is rotatable within the aperture without deforming any portion of the shaft.

9. The object of claim 8, wherein the first piece further includes a second end opposite the first end, and a second deformable section having opposing first and second bars extending from the second end of the shaft, the second deformable section having a width defined by its opposing first and second bars.

10. The object of claim 9, wherein the first and second notches are further defined by the first and second bars, respectively, of the second deformable section.

11. The object of claim 9, wherein the shaft has first and second shaft edges, and the shaft is fitted in the aperture with the first and second shaft edges adjacent at least one edge of the aperture to effectuate the connection.

12. The object of claim 9, further comprising a third piece, the third piece including an aperture having a width with a smallest dimension which is greater than the width of the shaft of the first deformable section of the first piece; and wherein the bars of the first deformable section are deformed to insert the first deformable section through the apertures of the second and third pieces to effectuate a connection of the first deformable section with the second and third pieces at the location of the apertures, the second and third pieces being disposed generally parallel to each other.

13. The object of claim 8, wherein the aperture has a circular configuration with a circumferential edge.

14. The object of claim 8, wherein the second piece further includes a longitudinal side edge, and a slit extending from the aperture to the longitudinal side edge defining first and second deformable body portions adjacent the slit.

15. The object of claim 9, wherein the first piece further includes a third deformable section having first and second bars extending in opposite directions from a central portion of the shaft, with the first notch defined by the first bars of the first and third deformable sections, the second notch defined by the second bars of the first and third deformable sections, a third notch defined by the first bars of the second and third deformable sections, and a fourth notch defined by the second bars of the second and third deformable sections.

16. The object of claim 15, wherein at least one piece is received inside the first and second notches, and at least one piece is received inside the third and fourth notches.

17. The object of claim 15, wherein the bars of the third deformable section are deformed to insert the third deformable section through the aperture of the second piece to effectuate a connection of the third deformable section with the second piece at the location of the aperture.

18. The object of claim 8, wherein the first piece further includes a second shaft having a first end, and a second deformable section including opposing first and second bars extending from the first end of the second shaft, a first notch defined by the first bar and the second shaft, and a second notch defined by the second bar and the second shaft, the second deformable section having a width defined by its opposing first and second bars; and wherein the first and second deformable sections are disposed at right angles to each other.

19. The object of claim 18, further including a third piece having a body and an aperture having a width with a smallest dimension which is greater than the width of the shaft of the first deformable section of the first piece;

wherein the opposing first and second bars of the first deformable section of the first piece are deformed to insert the first deformable section through the aperture of the second piece to effectuate a connection of the first deformable section with the second piece at the location of the aperture of the second piece, and the opposing first and second bars of the second deformable section of the first piece are deformed to insert the second deformable section through the aperture of the third piece to effectuate a connection of the second deformable section with the third piece at the location of the second aperture, such that the second and third pieces are disposed at right angles to each other.

20. The object of claim 19, wherein at least one piece is received inside the first and second notches of the first deformable section, and at least one piece is received inside the first and second notches of the second deformable section.

21. The object of claim 18, wherein the first piece further includes an aperture.

22. The object of claim 8, wherein the first piece has four deformable sections, each deformable section oriented approximately ninety degrees from its two adjacent deformable sections and having left and right notches on opposite side edges of its shaft.

23. The object of claim 8, wherein the second piece further includes a second aperture, and wherein the object further includes:

a third piece having a shaft having a first end, the third piece further including a first deformable section including opposing first and second bars extending from the first end of the shaft to define first and second notches, the first deformable section having a width defined by the opposing first and second bars; and wherein the opposing first and second bars of the first deformable section of the third piece are deformed to insert the first deformable section through the second aperture of the second piece to effectuate a connection of the first deformable section of the third piece with the second piece at the location of the second aperture.

24. The object of claim 8, wherein the shaft is fitted in the aperture of the second piece to effectuate the connection, with the shaft being rotatable within the aperture without deforming any portion of the shaft.

25. The object of claim 8, wherein the object further comprises a plurality of cut-outs that have the same configuration and size as the aperture of the second piece.

26. A method of assembling a plurality of pieces to create an object, comprising:

a. providing a first piece having a shaft having a first end, the first piece further including a first deformable section including opposing first and second bars extending from the first end of the shaft to define first and second notches, the first deformable section having a width defined by the opposing first and second bars;

b. providing a second piece including an aperture having a width with a dimension which is the same as or greater than the width of the shaft of the first deformable section of the first piece;

c. bending the opposing bars of the first deformable section to insert the first deformable section through the aperture of the body piece to effectuate a connection of the first deformable section with the second piece at the location of the aperture; and d. rotating the first deformable section of the first piece within the aperture without deforming any portion of the shaft.

27. The method of claim 26, further comprising:

d. providing a third piece including an aperture having a width with a smallest dimension which is the same as or greater than the width of the shaft of the first deformable section of the first piece; and e. bending the opposing bars of the first deformable section to insert the first deformable section through the aperture of the third piece to effectuate a connection of the first deformable section with the third piece at the location of the aperture.

28. The method of claim 26, wherein the second piece further includes an aperture, the method further comprising:

d. providing a third piece having a shaft having a first end, the third piece further including a first deformable section including opposing first and second bars extending from the first end of the shaft to define first and second notches, the first deformable section having a width defined by the opposing first and second bars; and e. bending the opposing bars of the first deformable section of the third piece to insert the first deformable section of the third piece through the aperture of the second piece.

* * * * *